US010576492B2

(12) United States Patent
Utsumi et al.

(10) Patent No.: US 10,576,492 B2
(45) Date of Patent: Mar. 3, 2020

(54) SURFACE TREATING APPARATUS

(71) Applicant: C. Uyemura & Co., Ltd., Osaka (JP)

(72) Inventors: Masayuki Utsumi, Osaka (JP); Masahito Tanigawa, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 0 days.

(21) Appl. No.: 15/727,109

(22) Filed: Oct. 6, 2017

(65) Prior Publication Data

US 2018/0117618 A1 May 3, 2018

(30) Foreign Application Priority Data

Nov. 2, 2016 (JP) ..... 2016-215329

(51) Int. Cl.
*B05C 5/00* (2006.01)
*B05C 11/11* (2006.01)
(Continued)

(52) U.S. Cl.
CPC ..... *B05C 5/002* (2013.01); *B05C 5/0208* (2013.01); *B05C 11/11* (2013.01); *B08B 3/041* (2013.01);
(Continued)

(58) Field of Classification Search
None
See application file for complete search history.

(56) References Cited

U.S. PATENT DOCUMENTS 3,025,828 A * 3/1962 Heilman ..... B05C 11/11 118/419
3,955,532 A * 5/1976 Hall ..... B01F 11/0088 118/612
(Continued)

FOREIGN PATENT DOCUMENTS

JP 2014-043613 A 3/2014
JP 2014-088600 A 5/2014
(Continued)

OTHER PUBLICATIONS

Official Letter (Including Translation) for corresponding Taiwan Patent Application No. 106121745 mailed Aug. 1, 2019.

*Primary Examiner* — Jethro M. Pence
(74) *Attorney, Agent, or Firm* — Jason H. Vick; Sheridan Ross, PC

(57) ABSTRACT

A surface treating apparatus that suppresses occurrence of defects is provided. A treatment solution is accumulated in a tank 15 through a treatment solution collecting port/air discharging port 13 in a lower portion of a body 4. An air heated by the treatment solution flows toward an upper portion (portion without the treatment solution) of the tank 15 via the treatment solution collecting port/air discharging port 13 in the lower portion of the body 4, and is discharged via an exhaust duct 17. In this way, the air that is heated and tends to flow upward in the body 4 is discharged from the lower portion thereof and is replaced with an external air from the upper portion thereof. Accordingly, the air in the body 4 can be maintained at a uniform temperature. Thus, the treatment solution that reaches a lower portion of a substrate 54 from an upper portion thereof can be maintained at a uniform temperature. The air is caused to flow toward the lower portion from the upper portion in the body 4, so that the substrate 54 is pulled downward, and swinging
(Continued)

of the substrate 54 can thus be reduced. Therefore, the substrate 54 can be less likely to contact an inlet 44 and an outlet 46.

8 Claims, 30 Drawing Sheets

(51) Int. Cl.

| | |
|---|---|
| ***B05C 5/02*** | (2006.01) |
| ***B08B 3/04*** | (2006.01) |
| ***C25D 17/02*** | (2006.01) |
| ***C25D 21/02*** | (2006.01) |
| ***B08B 11/02*** | (2006.01) |
| ***C23C 18/16*** | (2006.01) |
| *B05C 3/09* | (2006.01) |
| *C23C 18/38* | (2006.01) |

(52) U.S. Cl.
CPC ..... *B08B 11/02* (2013.01); *C23C 18/168* (2013.01); *C23C 18/1619* (2013.01); *C23C 18/1632* (2013.01); *C25D 17/02* (2013.01); *C25D 21/02* (2013.01); *B05C 3/09* (2013.01); *C23C 18/38* (2013.01)

(56) References Cited

U.S. PATENT DOCUMENTS

| | | | | |
|---|---|---|---|---|
| 4,622,917 | A * | 11/1986 | Schramm | C23C 18/1616 118/315 |
| 6,540,830 | B1 * | 4/2003 | Russell, Jr. | B05C 5/002 118/206 |
| 2008/0102210 | A1 * | 5/2008 | Armanini | C23C 18/1619 427/304 |
| 2009/0194139 | A1 | 8/2009 | Nakada et al. | |
| 2011/0284037 | A1 | 11/2011 | Nakada et al. | |
| 2012/0017458 | A1 | 1/2012 | Nakada et al. | |
| 2013/0312666 | A1 * | 11/2013 | Shih | H01L 21/67126 118/728 |
| 2014/0053774 | A1 | 2/2014 | Hotta et al. | |
| 2014/0116334 | A1 | 5/2014 | Hotta et al. | |

FOREIGN PATENT DOCUMENTS

| | | | |
|---|---|---|---|
| TW | 200942647 | A | 10/2009 |
| TW | 201408820 | A | 3/2014 |

* cited by examiner

SURFACE TREATING APPARATUS

CROSS REFERENCE TO RELATED APPLICATIONS

This application claims the benefit under 35 U.S.C. 119(a) to Japanese Patent Application No. JP 2016-215329, filed Nov. 2, 2016, the entire disclosure of which is incorporated herein by reference in its entirety.

BACKGROUND OF THE INVENTION

1. Field of the Invention

This invention relates to a technology to perform surface treatment such as plating on works such as thin plates.

2. Description of the Related Art

When surface treatment such as plating is performed on a substrate and the like, it has been common to use a method of immersing the substrate in a plating bath that is filled with a plating solution. This method requires a lifting mechanism to lift and lower the substrate, which leads to a problem of complication and enlargement of an apparatus. In addition, the plating bath has to be filled with the plating solution, which leads to a problem of requiring a large quantity of the plating solution. These problems are not only inherent in plating but are common to the surface treatment as a whole.

In order to solve such problems, the inventors have invented an apparatus that releases a treatment solution to the substrate whose upper portion is held, collects the treatment solution dropped from the substrate, and releases the treatment solution again (JP-A-2014-88600, JP-A-2014-43613).

FIG. 25 shows a transverse cross-section of a surface treating apparatus described in JP-A-2014-88600. An upper portion of a substrate 2 is held by a hanger 6 as a holding member. Roller receiving members 40 and 42 are provided outside a body 4. A mobile body 14 that holds the hanger 6 is held by a roller 16, and moves in a perpendicular direction to the sheet.

The substrate 2 is introduced into the body 4. In the body 4, treatment solution releasing sections 8 having treatment solution jet ports 10 are provided on both sides of the substrate 2. A treatment solution is ejected from the treatment solution jet ports 10 onto the substrate 2. The treatment solution having reached the substrate 2 flows down the surfaces of the substrate 2. In this way, the surface of the substrate 2 is treated by the treatment solution.

The treatment solution that has run down is collected in a lower portion of the body 4 and is released again from the treatment solution releasing section 8 by a pump 12.

FIG. 26 shows a plan view. The substrate 2 held by the hanger 6 is transported from a loading section 22 through a first cleaning section 24, a desmear section 26, a second cleaning section 28, a pretreatment section 30, a third cleaning section 32, an electroless copper-plating section 34, and a fourth cleaning section 36 to an unloading section 38, where it is removed from the hanger 6.

While each bath has the same transverse cross-section as that shown in FIG. 25, the treatment solution ejected from the treatment solution jet ports 10 differs depending on the baths. As shown in FIG. 26, an upper portion of each bath is open.

In this way, the use of treatment solution can be reduced without complicating and enlarging the apparatus.

In the above related art, however, the treatment solution flows from the upper portion of the substrate toward the lower portion thereof. Thus, if a temperature of the treatment solution is not the same as ambient temperature, a temperature at which the ejected treatment solution reaches the upper portion of the substrate may be different from a temperature at which the treatment solution flows down and reaches the lower portion of the substrate.

In the apparatus of the above related art, the upper portion of each body 4 is open, as shown in FIG. 25. Thus, if the temperature of the treatment solution is higher than room temperature, warm air is discharged from the upper portion, and air is sucked from a communicating port 37 that communicates with the loading section 22 and a communicating port 37 that communicates with the unloading section 38 in FIG. 26.

However, the upper portion of each body 4 is always at high temperature while the lower portion thereof is at low temperature, which results in a difference in temperature.

In addition, a configuration in which the upper portion of each body 4 is not open and is covered as much as possible is conceivable to prevent contamination by dust. However, with such a configuration, even if an exhaust port is provided on the upper portion, a problem in which the upper portion is at high temperature is noticeable.

The treatment on the upper portion of the substrate 2 is not the same as that on the lower portion thereof due to the difference in temperature, which results in difficulties. Such a problem is described with an example of desmear treatment.

The desmear treatment intends to prevent plating defects by roughening a surface of the substrate before plating to increase adhesion with plating. In the desmear treatment, a swelling step, a roughening step, and a neutralizing step are performed in the stated order. Kinds of the treatment solution ejected from the treatment solution jet ports 10 vary by each of the steps.

The swelling step is a step of penetrating a swelling agent through a substrate. The swelling step is preferably performed with the swelling agent at about 40 degrees. As shown in FIG. 27A, the substrate 2 is formed such that a resin 90 is filled with fillers 92. The swelling agent penetrates through the substrate to an appropriate depth in the swelling step performed to increase a speed of treatment for removing the fillers 92 with a permanganate solution or the like in the following roughening step. A penetration layer 94 shown in FIG. 27A shows a layer through which the swelling agent penetrates.

The roughening step is a step of roughening the surface of the substrate 2 to an appropriate depth with the permanganate solution at about 70 degrees. As shown in FIG. 27B, the fillers 92 around the area through which the swelling agent has penetrated are mostly removed, and the surface is thereby roughened.

The neutralizing step is a step of neutralizing, with a neutralizing agent, the surface of the substrate 2 that has been oxidized with the permanganate solution.

Plating is performed on the surface in the state of being a rough surface as shown in FIG. 27B, and the adhesion between the plating and the substrate 2 thus increases.

If a temperature of the swelling agent in the swelling step is low, the swelling agent penetrates only a short distance into the surface of the substrate as shown in FIG. 27C. Accordingly, a region to be roughened is shallow in the following roughening step with the permanganate solution. In addition, if a temperature of the permanganate solution is low, roughening capacity is also even more decreased. Thus, as shown in FIG. 27D, only the shallow region of the surface is roughened. In this way, the adhesion between the plating and the substrate 2 may be decreased.

On the other hand, if a temperature of the swelling agent in the swelling step is high, the swelling agent penetrates a long distance into the surface of the substrate as shown in FIG. 27E. Accordingly, the surface of the substrate 2 is roughened to a deep depth, as shown by a roughened layer 96 in FIG. 27F. This increases the adhesion between the plating and the roughened layer 96, but the swelling agent and the permanganate solution reduce the strength of the roughened layer 96. This leads to a problem in which the roughened layer 96 is more likely to be peeled off the substrate 2.

Thus, the situation where the treatment solution differs in temperature between the upper portion of the substrate and the lower portion thereof also causes plating defects.

In addition, the desmear treatment not only has the operational effects of improving the adhesion with the plating, but also has the operational effects of preventing plating defects by removing resin residues after drilling and laser processing. Also in this case, if the treatment solution differs in temperature between the upper portion of the substrate and the lower portion thereof, only the resin residues at the upper portion or the lower portion may not be appropriately melted without melting the substrate 2 more than necessary.

Furthermore, also in plating treatment, an amount of deposition differs depending on a temperature of a plating solution. FIG. 28 illustrates a relationship between a temperature of a treatment solution and a deposition thickness of plating. The horizontal axis shows a temperature of the treatment solution, and the vertical axis shows a deposition thickness in treatment performed for 10 minutes. Thus, in the plating treatment performed for 10 minutes, if a temperature of the treatment solution differs by 2 degrees, a thickness of plating differs by 0.1 μm. In other words, the thickness of plating is not uniform at the upper portion of the substrate and the lower portion thereof, causing a difference in the thickness of plating by 0.1 μm. Also in the other treatment, a difference in temperature of the treatment solution is not preferable.

As described above, the difference in temperature of the treatment solution between the upper portion of the substrate and the lower portion thereof causes nonuniformity of the treatment, which causes deterioration in quality.

In addition, the following problem also arises. As shown in FIG. 26, the communicating ports 37 that allow movement of the substrate 2 held by the hanger 6 are provided between the baths of the treatment sections. A release of a treatment solution Q shown in FIG. 25 is avoided in the vicinity of the communicating port 37. This is because the treatment solution is prevented from entering an adjacent bath. Specifically, the treatment solution Q is released at a distance of 50 to 200 mm from the communicating port 37. The treatment solution Q is more likely to enter the bath at a distance of 50 mm or shorter while it is uneconomical to use a longer apparatus if the treatment solution Q is released at a distance of 200 mm or longer.

On the other hand, if the substrate 2 is a thin plate, the treatment solution Q that flows down vertically maintains the substrate 2 straight, as shown by a region 7 in FIG. 29. However, the treatment solution Q is not released in the vicinity of the communicating port 37 provided in a wall 5 between the body 4 and the body 4, so that the substrate 2, which is a thin plate, is not maintained by the treatment solution Q.

If air is discharged from the upper portion of the body 4 as described above in this state, convection of air from the lower portion to the upper portion occurs, as indicated by an arrow 9, which causes the substrate 2 to swing and move. The communicating port 37 is configured to be as narrow as possible so as to prevent the treatment solution in the adjacent body 4 from being splattered. Accordingly, the swung and moved substrate 2 may come in contact with the communicating port 37, which possibly leads to slipping off the position held by the hanger and tearing of the substrate 2.

The invention solves at least one of the above problems and therefore has a purpose of providing a surface treating apparatus that suppresses occurrence of defects.

SUMMARY OF THE INVENTION

Several features of a surface treating apparatus according to this invention that are independently applicable will be listed below.

(1) A feature of a surface treating apparatus according to one embodiment of this invention is that it includes: a holding member that holds an upper portion of a treatment target; a treatment solution releasing section that discharges a treatment solution onto the holding member or the treatment target to allow the treatment solution to flow on a surface of the treatment target held by the holding member; and a body that accommodates at least the treatment solution releasing section and the treatment target, and that an air intake is provided in an upper portion of the body, and an air discharging port is provided in a lower portion of the body.

Accordingly, an air heated by the treatment solution is discharged from the air discharging port in the lower portion, and a cool air can be taken in through the upper portion. This can keep the air in the bath at a uniform temperature, and thus a difference in temperature of the treatment solution between the upper portion of the treatment target and a lower portion thereof can be reduced.

(2) A feature of a surface treating apparatus according to another embodiment of this invention is that it includes: a continuous body that is a bath connecting body including a plurality of bath bodies connected to each other and is provided with a communicating port in each body for communicating with an adjacent body; a holding member that holds an upper portion of a treatment target; a transferring mechanism that moves the holding member to move the treatment target into each body via the communicating port of the continuous body; and a treatment solution releasing section that is a treatment solution releasing section provided in each body and discharges a treatment solution onto the holding member or the treatment target to allow the treatment solution to flow on a surface of the treatment target held by the holding member, in which the treatment solution releasing section is configured not to discharge the treatment solution onto the treatment target in the vicinity of the adjacent body such that the treatment solution is not splattered on the adjacent body via the communicating port, and that an air intake is provided in an upper portion of the body, and an air discharging port is provided in a lower portion of each body in the vicinity of the adjacent body.

Accordingly, the treatment target is pulled downward by the flow of the air also in an area where the treatment solution is not dropped, and the treatment target can thus be stabilized.

(3) Another feature of the surface treating apparatus according to this invention is that the air intake is provided above a portion where the treatment solution discharged from the treatment solution releasing section contacts the treatment target, and the air discharging port is provided below the treatment target.

Accordingly, a more enhanced effect of stabilizing a temperature or stabilizing a position can be obtained.

(4) Another feature of the surface treating apparatus according to this invention is that the air discharging port is used as a collecting port for collecting the treatment solution.

Accordingly, the structure of the apparatus can be simplified.

(5) Another feature of the surface treating apparatus according to this invention is that it further includes: an upper supporting member that supports the holding member from above; a transferring mechanism that moves the upper supporting member; and a protective member that is provided at least on a lower side of the transferring mechanism, and that the upper supporting member supports the holding member through a part where no protective member is provided.

Accordingly, the protective member can prevent dust from entering the treatment solution.

(6) Another feature of the surface treating apparatus according to this invention is that the protective member is also provided on side surfaces of the transferring mechanism.

Accordingly, an effect of preventing contamination by dust can be further enhanced.

(7) Another feature of the surface treating apparatus according to this invention is that a fluid is filled in a space defined by the protective member so that the lower side of the transferring mechanism or at least a part of the transferring mechanism can be immersed in the fluid.

Accordingly, dust can be prevented from being stirred up, and an effect of preventing contamination by dust can be further enhanced.

(8) Another feature of the surface treating apparatus according to this invention is that a water supply port and a water drain port are provided in the space defined by the protective member so that the fluid can be replaced.

Accordingly, a fluid contaminated by dust can be replaced with a new fluid.

(9) Another feature of the surface treating apparatus according to this invention is that the transferring mechanism is formed of stainless steel, titanium, carbon steel, brass, or plastic.

Accordingly, corrosion of the transferring mechanism by the fluid can be prevented.

In his invention, the term "holding member" refers to a member that has a function of holding at least an upper portion of a treatment target. In embodiments, treatment solution receiving members 82 fall under this definition.

The term "treatment solution releasing section" refers to a part that has a function of discharging a treatment solution directly or indirectly onto a treatment target. In embodiments, pipes 56 and slopes 53 fall under this definition.

The term "upper supporting member" refers to a member that has a function of holding at least a holding member from above. In embodiments, a top plate 62, hanging plates 64, a clip holding member 74, and clips 52 fall under this definition.

The term "transferring mechanism" refers to a mechanism that has a function of moving at least the upper supporting member. In embodiments, rollers 40 and roller guides 66, a pinion 70, and a rack 68 fall under this definition.

The term "protective members" refers to members that have a function of preventing dust generated or stirred up at least by the transferring mechanism from reaching the treatment target. In embodiments, lower protective walls 47 and lateral protective walls 49 fall under this definition.

The features of the present invention can be described broadly as set forth above. The structures and characteristics of the present invention will be apparent from the following detailed description of the invention together with those features, effects, and drawings.

DESCRIPTION OF THE PREFERRED EMBODIMENTS

1. First Embodiment

Figure 1:
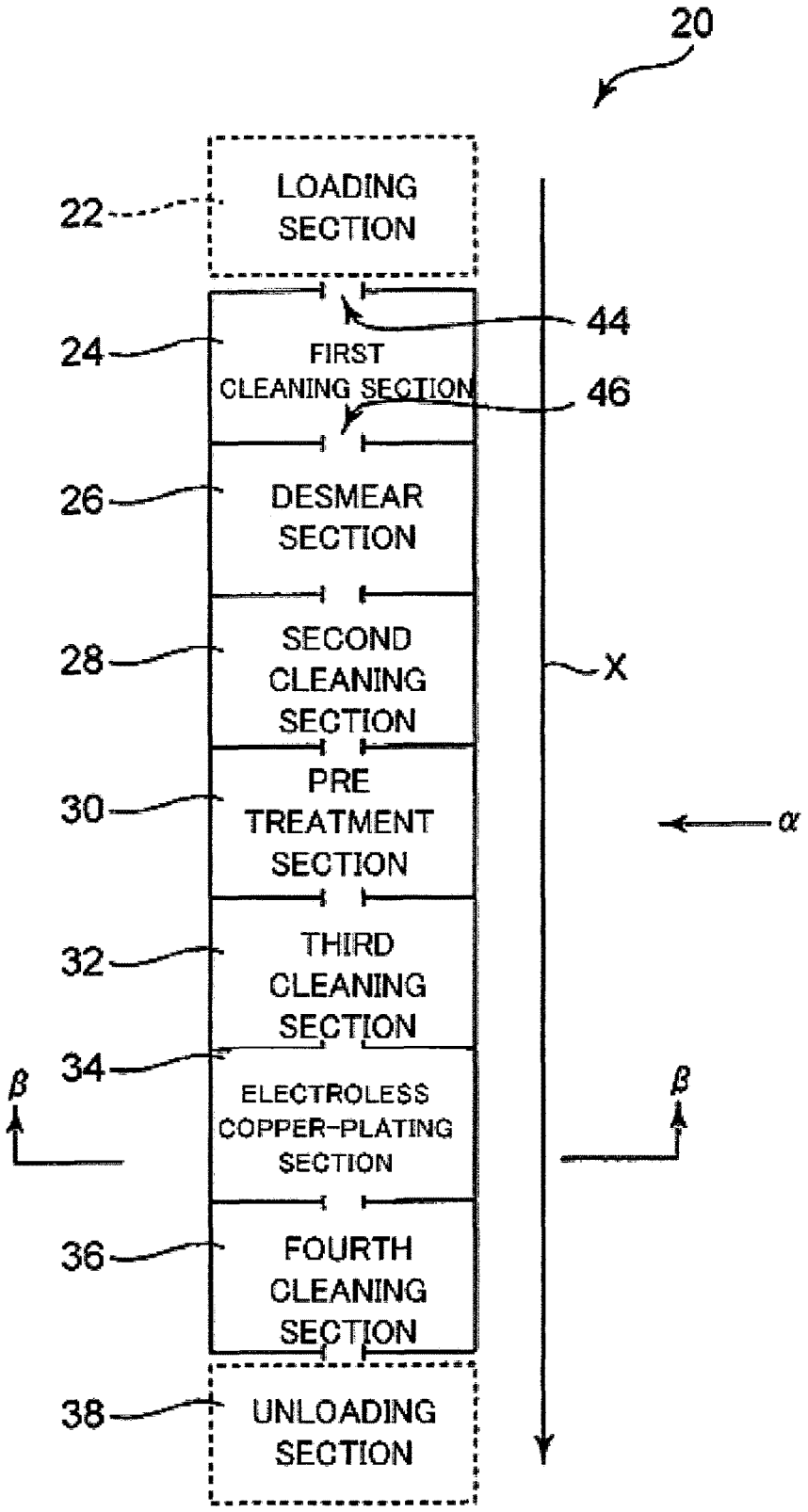
FIG. 1 is an overall configuration diagram of a surface treatment system according to one embodiment of the present invention.

FIG. 1 is a plan view of a surface treatment system 20 according to one embodiment of the present invention. This surface treatment system 20 includes a plurality of surface treatment sections. More specifically, the surface treatment system 20 includes a first cleaning section 24, a desmear section 26, a second cleaning section 28, a pretreatment section 30, a third cleaning section 32, an electroless copper-plating section 34, and a fourth cleaning section 36. Each of the treatment sections is provided with an inlet 44 and an outlet 46 as communicating ports. A substrate is moved in an X-direction through these communicating ports.

Figure 2:
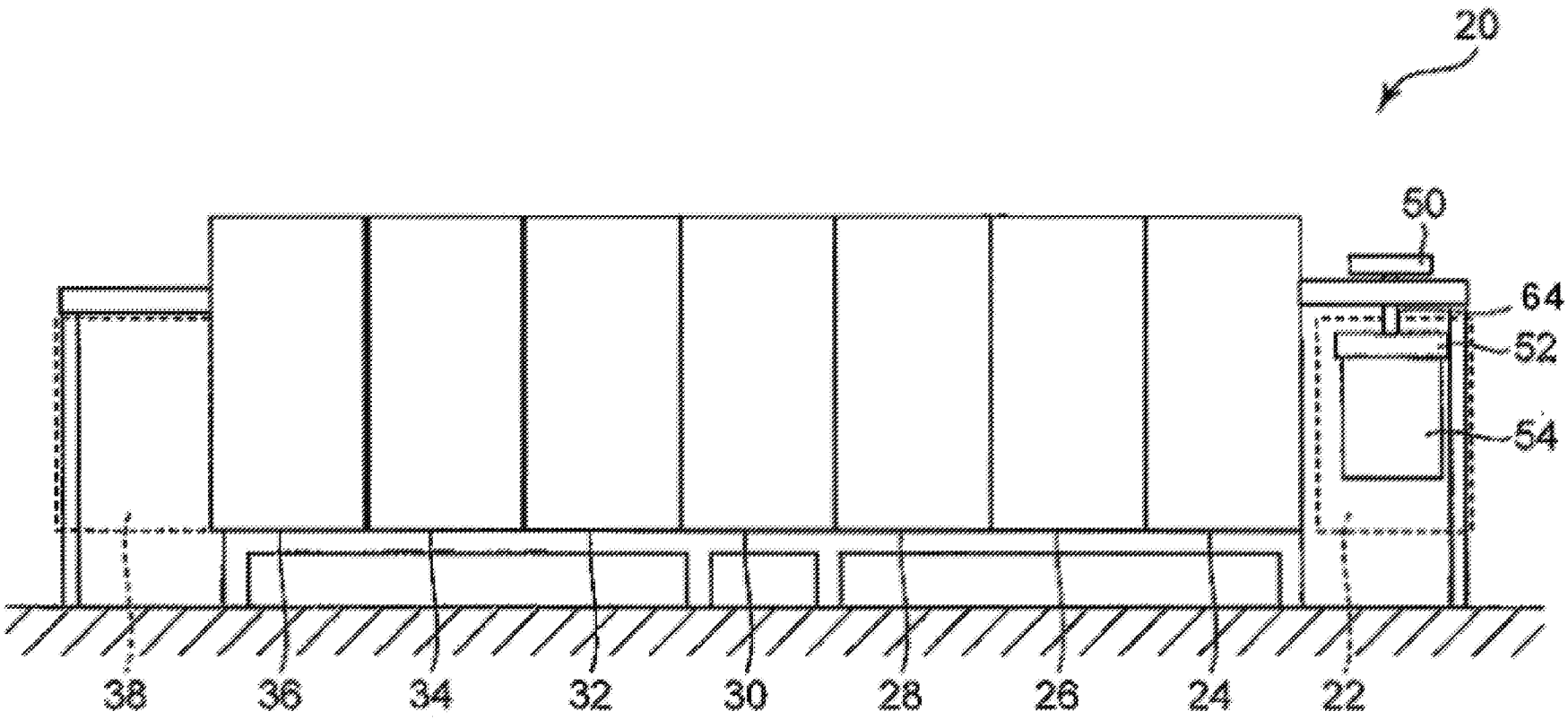
FIG. 2 is a side view of the surface treatment system in FIG. 1.

FIG. 2 is a view that is seen from an α-direction in FIG. 1. The surface treatment is performed on a substrate 54 that is held by a clip 52 of a hanger 50 as a holding member in an order of the first cleaning section 24, the desmear section 26, the second cleaning section 28, the pretreatment section 30, the third cleaning section 32, the electroless copper-plating section 34, and the fourth cleaning section 36.

Figure 3:
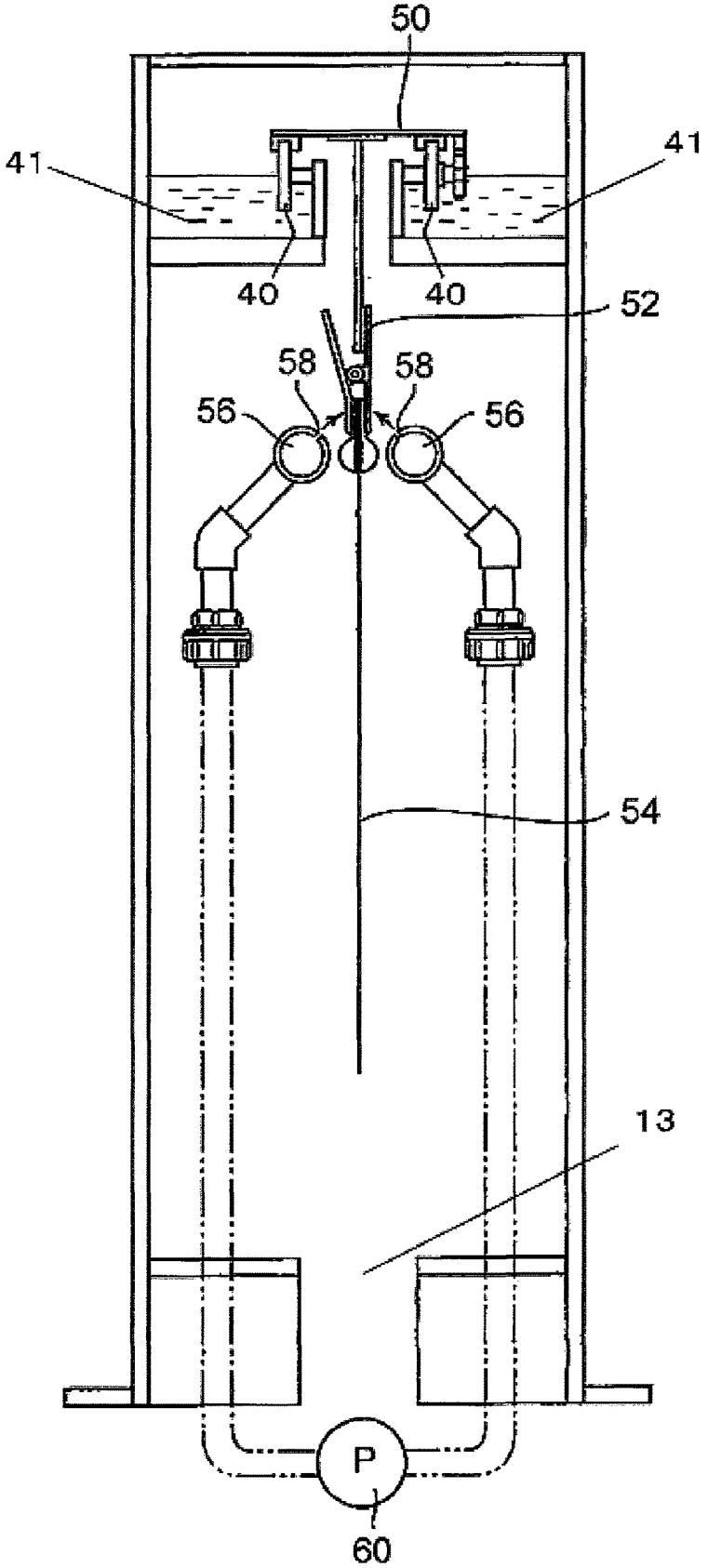
FIG. 3 is a cross-sectional view of the surface treating apparatus.

FIG. 3 is a cross-sectional view taken along β-β in FIG. 1. An upper end of the substrate 54 is sandwiched by the clip 52 of the hanger 50, and the substrate 54 is held in a vertical state. A pipe 56 as a treatment solution releasing section is provided on each side of the substrate 54 that is held by the hanger 50. Each of these pipes 56 is provided with a hole 58 through which the treatment solution is released obliquely upward. The released treatment solution flows down a surface of the substrate 54, reaches a treatment solution collecting port/air discharging port 13 in a lower portion thereof, is circulated by a pump 60, and is released from the pipe 56 again. In this embodiment, the treatment solution released from the pipe 56 as the treatment solution releasing section flows down the surface of the substrate 54 while the substrate 54 is not immersed in the treatment solution in any of the surface treatment sections, and the surface treatment is thereby performed.

Figure 4:
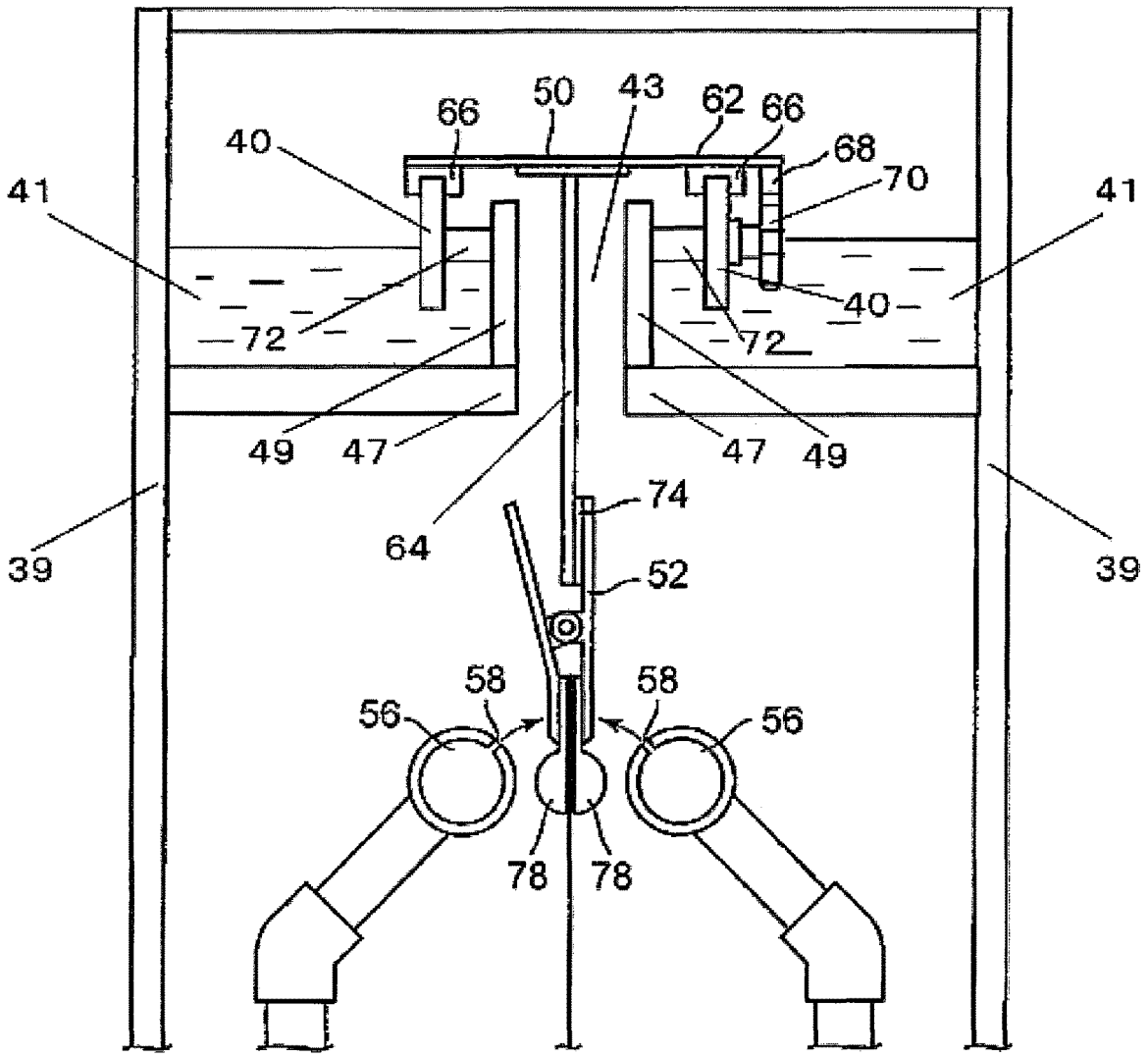
FIG. 4 is a detailed view of a portion near a hanger 50.

FIG. 4 is a detailed view of a portion near the hanger 50. The hanger 50 includes a top plate 62, a hanging plate 64 that extends in a downward direction from this top plate 62, and a clip holding member 74 that is fixed to the hanging plate 64. The clips 52 are provided on the clip holding member 74. In this embodiment, an upper supporting member is constituted by the top plate 62, the hanging plates 64, the clip holding member 74, and the clips 52.

Figure 5:
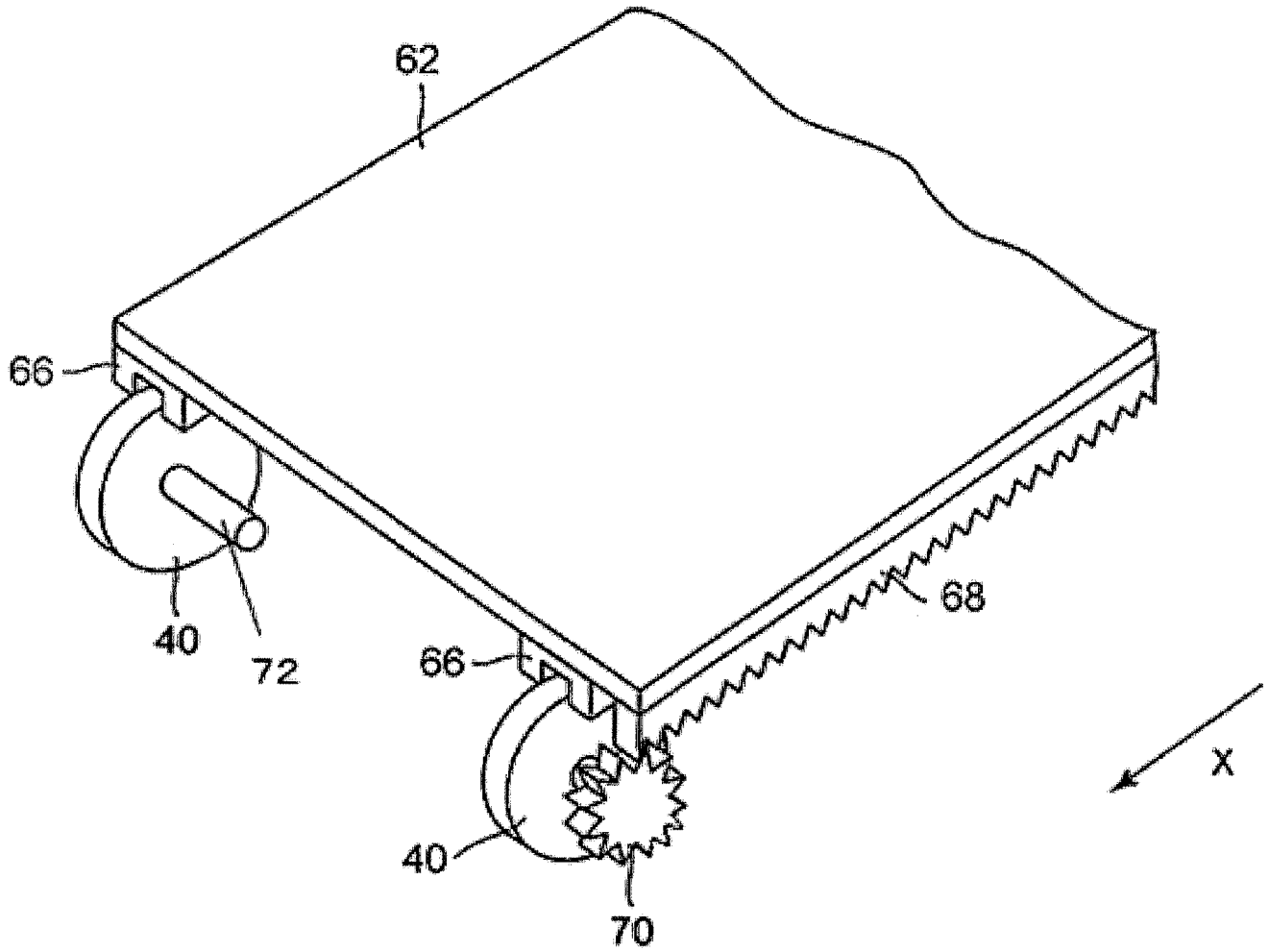
FIG. 5 is a view of roller guides 66 and a rack 68 of a top plate 62.

As shown in FIG. 5, a roller guide 66 is provided at each end on a lower side of a back surface of the top plate 62. Furthermore, a rack 68 is provided at the one end. A roller 40 is rotatably fitted to a recessed section of the roller guide 66. A pinion 70 is provided on the same rotary shaft 72 as the roller 40 and meshes with the rack 68. The pinion 70 is rotationally driven by a motor (not shown) and causes movement of the top plate 62 in the arrow X direction. In this way, the substrate 54 that is held by the hanger 50 is successively moved through each of the treatment sections. A plurality of rollers 40 and a plurality of pinions 70 are provided at predetermined intervals.

As shown in FIG. 4, the rollers 40 and the pinions 70 are fixed to the rotary shafts 72, which are provided to protrude from lateral protective walls 49 (protective members), so as to rotate with rotation of the rotary shafts 72. The lateral protective walls 49 are fixed perpendicularly to lower protective walls 47 (protective members) fixed to outer walls 39. The hanging plates 64 of the hanger 50 extend through a space 43 between both of the lower protective walls 47 and support the clips 52.

In this embodiment, the lower protective walls 47 and the lateral protective walls 49 are provided below and beside, respectively, a transferring mechanism (where two or more components slide on each other) constituted by the rollers 40 and the roller guides 66, and the pinions 70 and the rack 68. Thus, dust generated by the transferring mechanism can be prevented from migrating toward the substrate 54 held by the clips 52.

Moreover, in this embodiment, a liquid 41, such as water, is filled in spaces defined by the lateral protective walls 49, the lower protective walls 47, and the outer walls 39. The liquid 41 is filled to cover about half of each rotary shaft 72. Thus, fine dust generated by the transferring mechanism is captured by the liquid 41, and can be prevented from wafting in the air and migrating toward the substrate 54 through the space 43.

In this embodiment, in order to prevent corrosion caused by the liquid 41 (water), a plastic is used for the rollers 40, which are less affected by dimensional changes caused by wear, and a stainless material is used for the pinions 70, which must be less susceptible to the effect of dimensional changes caused by wear. Instead of or in conjunction with the stainless material, a metal such as titanium, carbon steel, or brass may be used.

Figure 24:
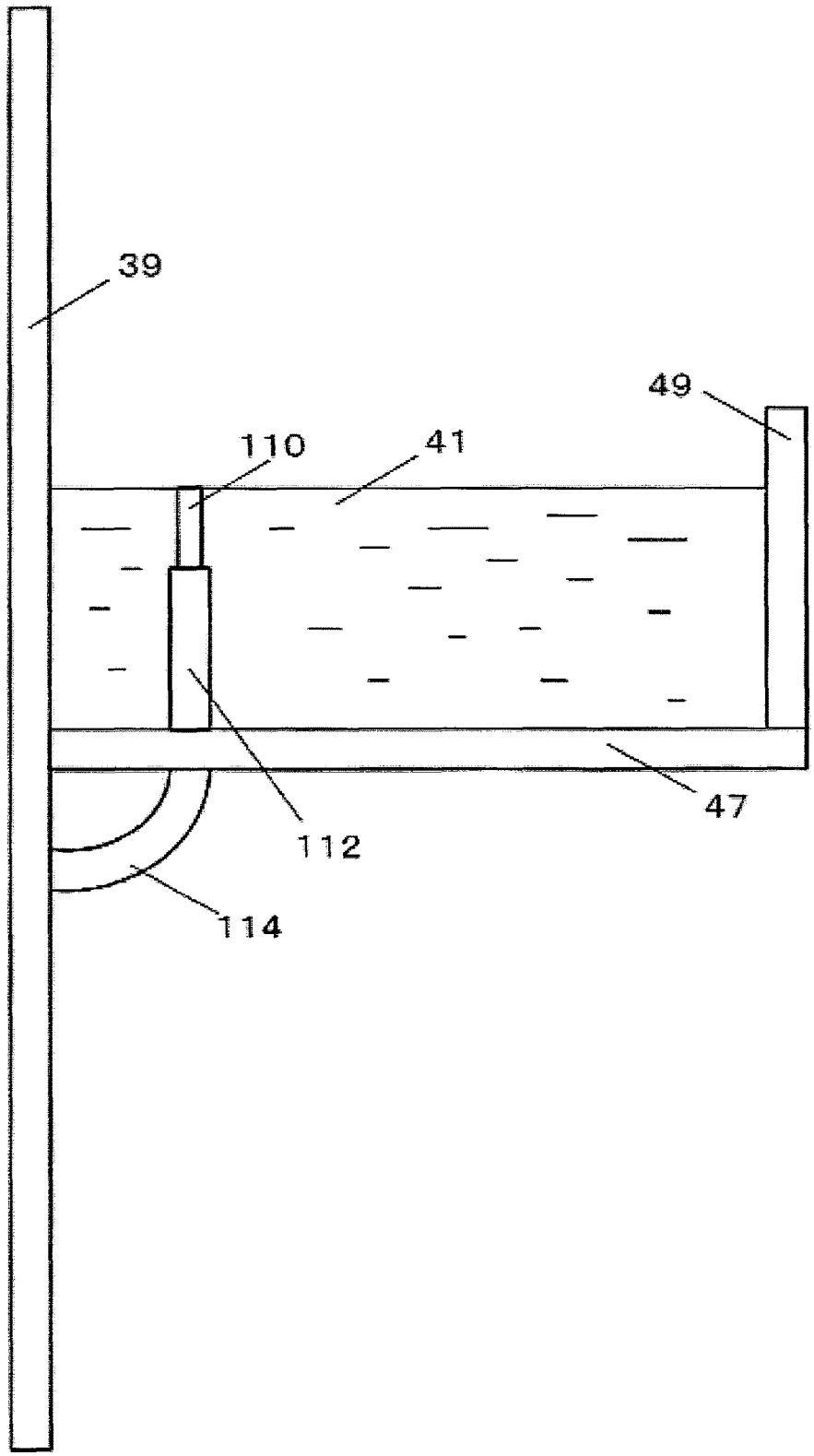
FIG. 24 is a diagram illustrating the structure of a drain port.
Figure 25:
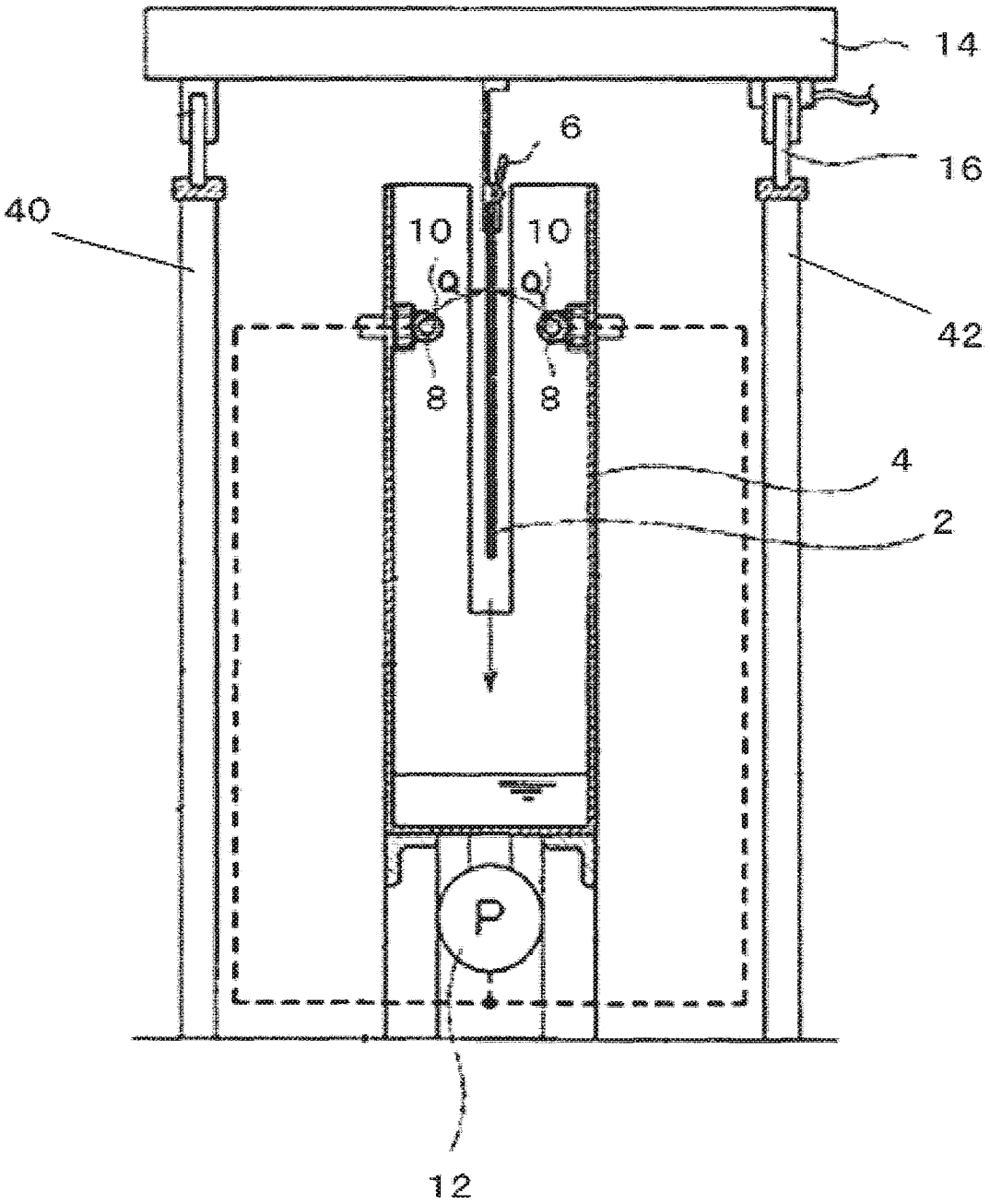
FIG. 25 (Prior Art)
FIG. 25 is a view of an example of a conventional surface treating apparatus.
Figure 26:
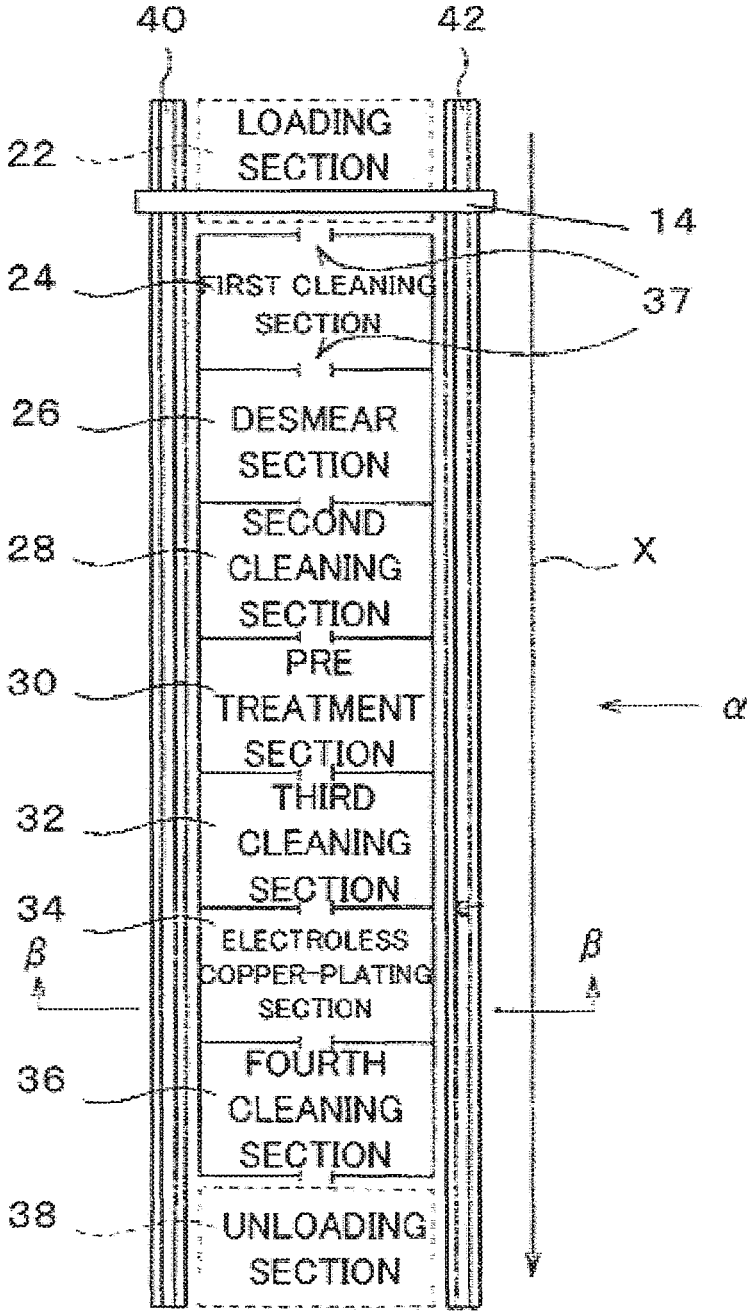
FIG. 26 (Prior Art)
FIG. 26 is a view of an example of a conventional surface treating apparatus.
Figure 27E:
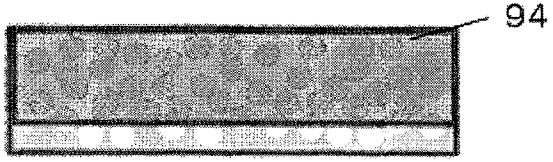
FIG. 27A, FIG. 27B, FIG. 27C, FIG. 27D, FIG. 27E, and FIG. 27F are diagrams for explaining changes in desmear treatment due to a difference in temperature of the treatment solution.
Figure 27F:
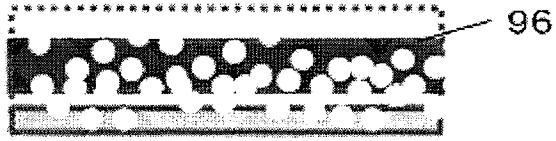
Figure 27C:
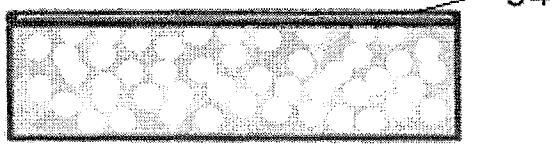
Figure 27D:
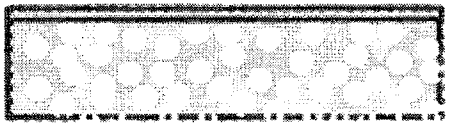
Figure 27A:
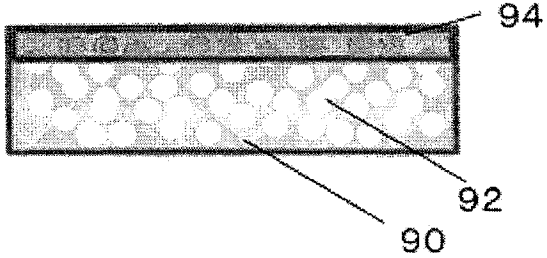
Figure 27B:
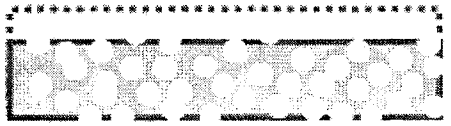
Figure 28:
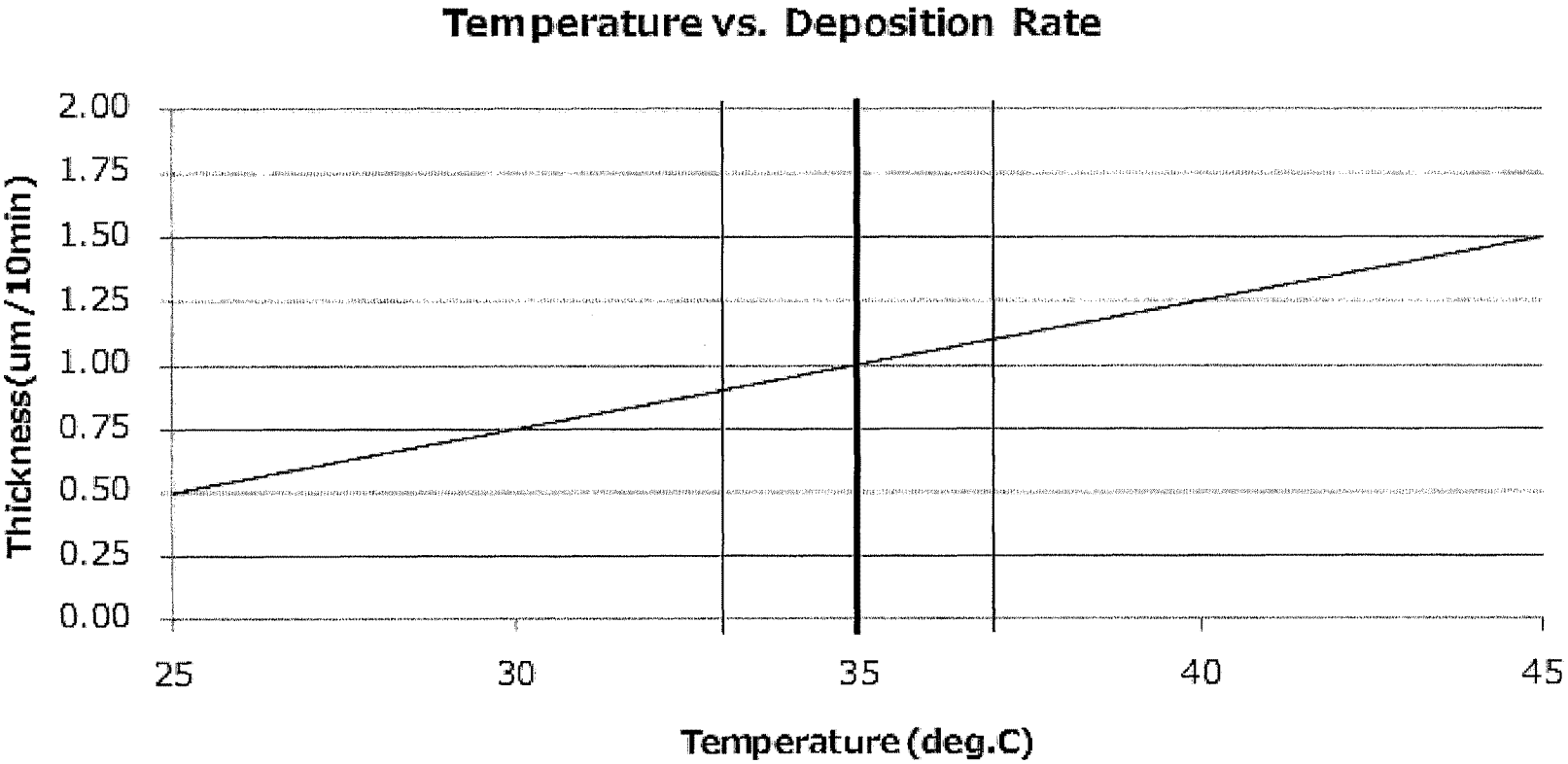
FIG. 28 is a diagram for explaining changes in plating treatment due to a difference in temperature of the treatment solution.
Figure 29:
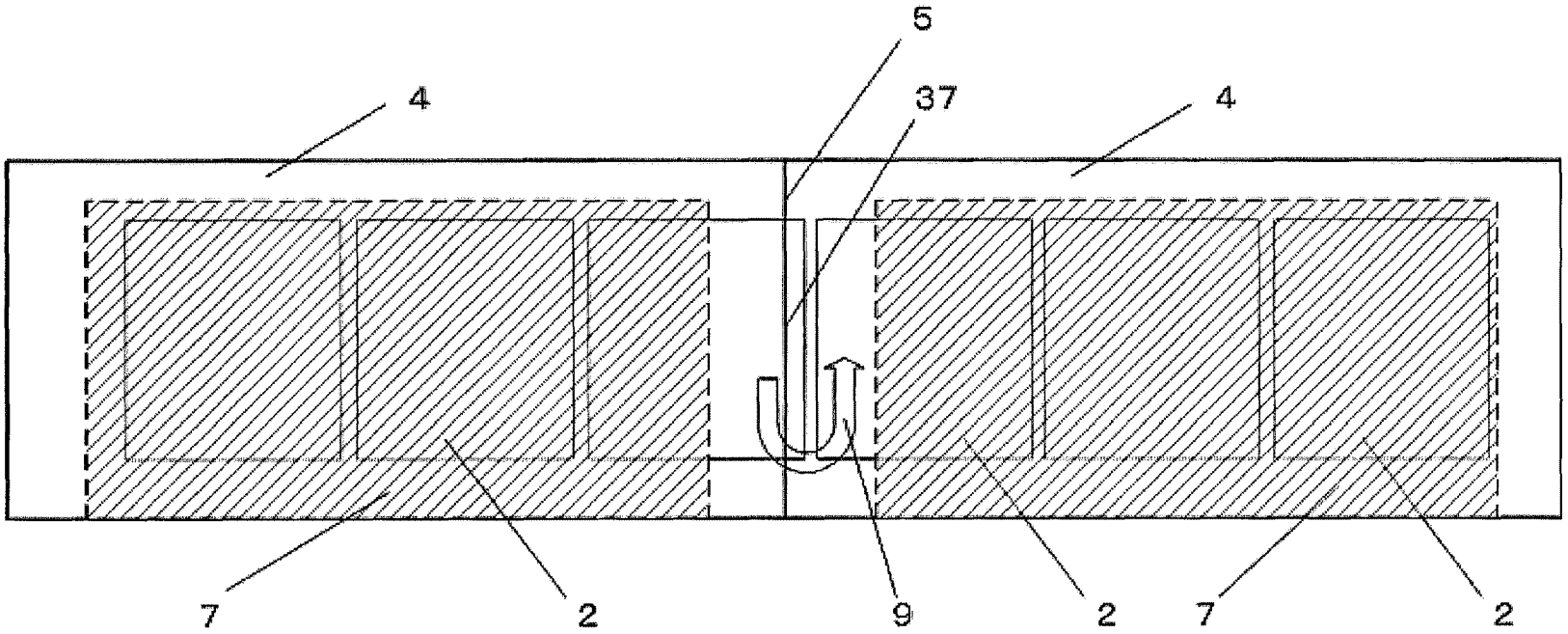
FIG. 29 is a diagram for explaining swinging of the substrate 2 in a portion where the treatment solution is not dropped.

In this embodiment, the liquid 41 is provided to extend from the first cleaning section 24 to the fourth cleaning section 36 (refer to FIG. 1). A water supply port (not shown) is provided on the inlet side of the first cleaning section 24, and a water drain port (not shown) is provided on the outlet side of the fourth cleaning section 36. The configuration of the water drain port is shown in FIG. 24. A base pipe 112 is fixed to the lower protective wall 47 and connected to a drainpipe 114. An adjustment pipe 110 that is movable up and down to adjust its height is inserted into the base pipe 112. The water level of the liquid 41 can be increased or decreased by changing the height of the adjustment pipe 110.

In addition, in this embodiment, the lower protective walls 47 are positioned higher in the vicinity of the water supply port than in the vicinity of the water drain port so that old liquid 41 (the liquid 41 containing dust) can be immediately drained.

Figure 6B:
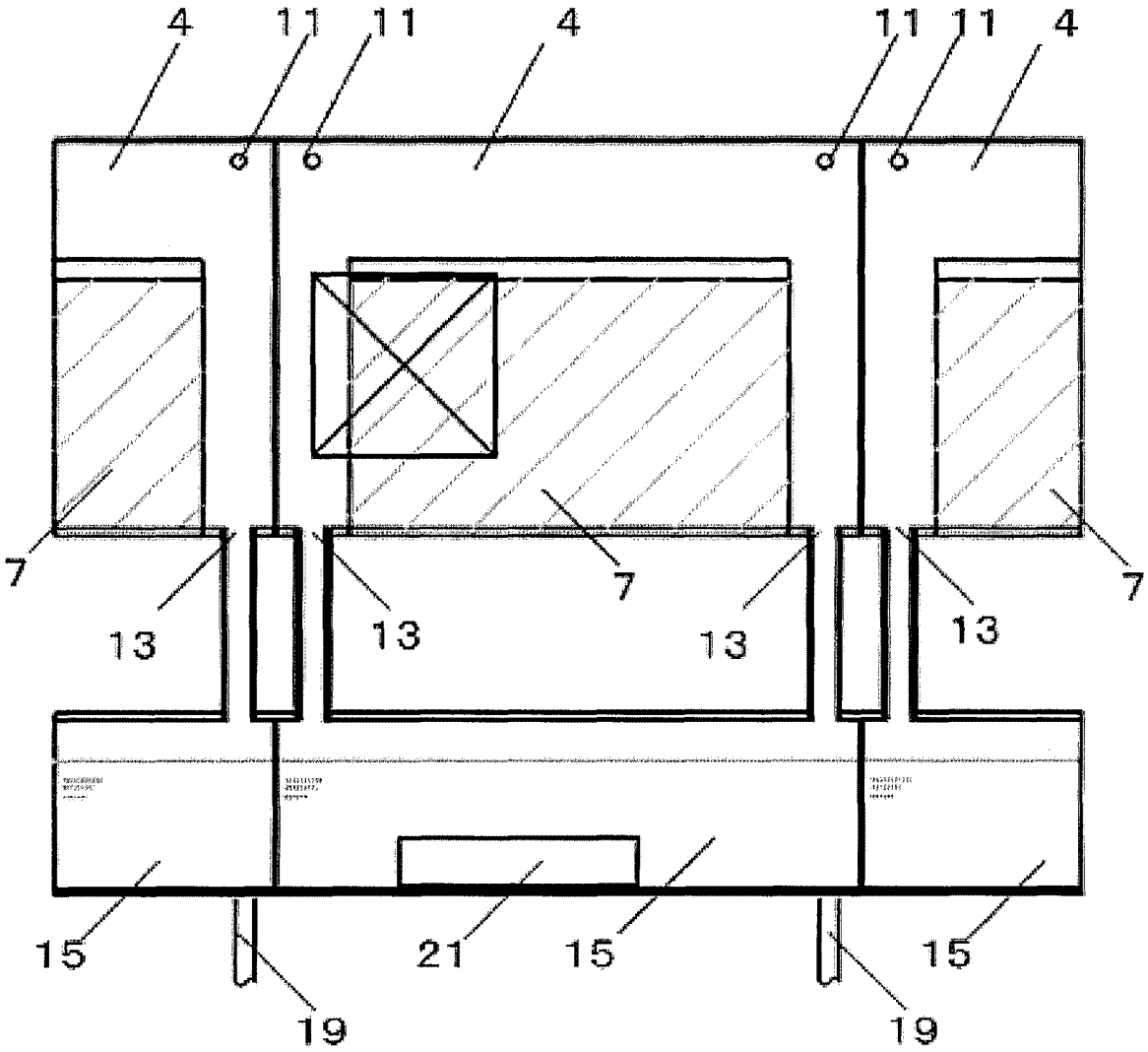
FIG. 6A and FIG. 6B are diagrams for explaining flows of a treatment solution and an air between each body 4 and a tank 15.
Figure 6A:
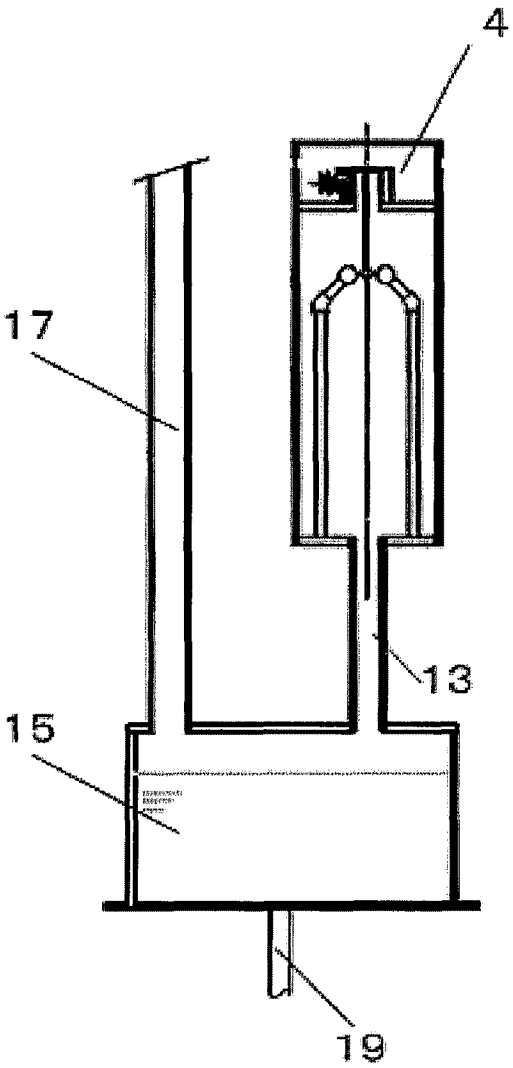

FIG. 6 shows a configuration for circulating the treatment solution and discharging air in each body 4. FIG. 6A is a side view and FIG. 6B is a front view.

A front end portion and a rear end portion of each body 4 are outside of a region 7 where the treatment solution is released. As described above, it prevents the treatment solution from being splattered on the adjacent body 4. The front end portion and the rear end portion of each body 4 are each provided with the treatment solution collecting port/air discharging port 13. The treatment solution flows down on the substrate 54 is guided to a tank 15 of each body 4 through this treatment solution collecting port/air discharging port 13. The treatment solution accumulated in the tank 15 is collected via a circulating pipe 19 connected to the tank 15, and is circulated through the pipes 56 in FIG. 3 via a pump (not shown) and a filter (not shown). Note that a heater 21 for heating the treatment solution is provided at the bottom of the tank 15.

An exhaust duct 17 provided with a fan (not shown) at a tip is provided on an upper portion of each tank 15. Thus, the air in the tank 15 is discharged via the exhaust duct 17. Accordingly, the air in the body 4 also flows toward the tank 15 through the treatment solution collecting port/air discharging port 13. The front end portion and the rear end portion of the body 4 are each provided with an air intake 11 at the upper portion thereof, so that the air outside is guided into the body 4.

The exhaust duct 17 is provided with a scrubber (not shown) as an air cleaning mechanism for cleaning harmful mist (air mixed with the vaporized treatment solution) generated in the body 4.

The upper portions of the body 4 and the tank 15 are not open and are covered. Thus, the openings of the body 4 and the tank 15 that communicate with the external air are limited to the air intake 11, the inlet 44, the outlet 46, and the exhaust duct 17. Among the openings above, the openings except for the exhaust duct 17 are caused to suck the air outside the body 4 by the function of the fan. Thus, the scrubber cleans the mist to harmless air and discharges it to the outside of the apparatus, so that pollution of the environment around the apparatus can be prevented.

The tank 15 is disposed below the treatment solution collecting port/air discharging port 13. The treatment solution in the body 4 is collected into the tank 15 while a height difference between the body 4 and the tank 15 and air suction by the fan are used.

Figure 7:
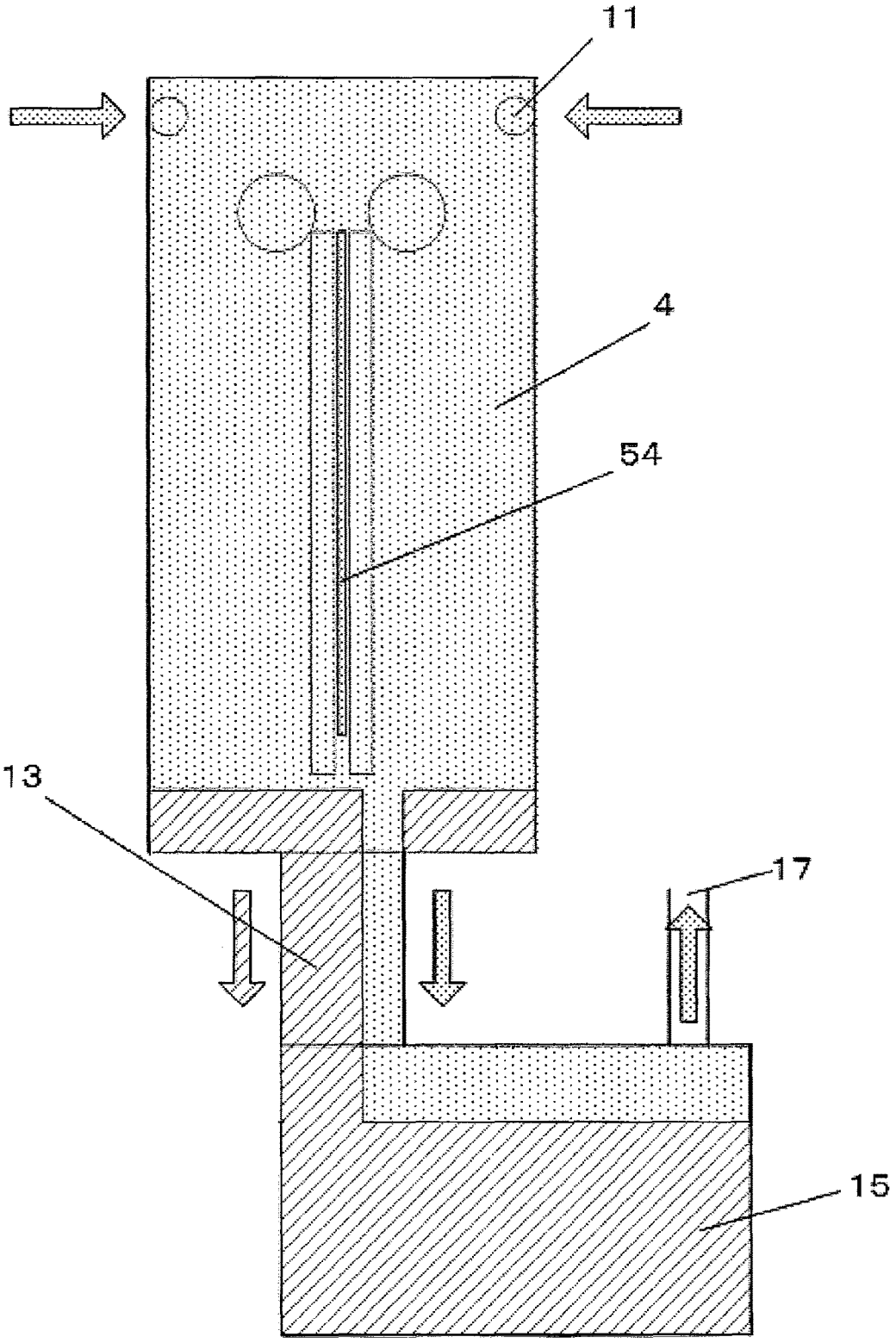
FIG. 7 is a diagram for explaining the flows of the treatment solution and the air between each body 4 and the tank 15.

The flows of the treatment solution and the air described above are schematically shown in FIG. 7. The treatment solution is accumulated in the tank 15 through the treatment solution collecting port/air discharging port 13 in the lower portion of the body 4. The air heated by the treatment solution flows toward the upper portion (portion without the treatment solution) of the tank 15 via the treatment solution collecting port/air discharging port 13 in the lower portion of the body 4, and is discharged via the exhaust duct 17. In this way, the air that is heated and tends to flow upward in the body 4 is discharged from the lower portion thereof and is replaced with an external air from the upper portion thereof. Accordingly, the air in the body 4 can be maintained at a uniform temperature. Thus, the treatment solution that reaches the lower portion of the substrate 54 from the upper portion thereof can be maintained at a uniform temperature.

In addition, the air is caused to flow toward the lower portion from the upper portion in the body 4, so that the substrate 54 is pulled downward, and swinging of the substrate 54 can thus be reduced. Therefore, the substrate 54 can be less likely to contact the inlet 44 and the outlet 46.

Figure 8:
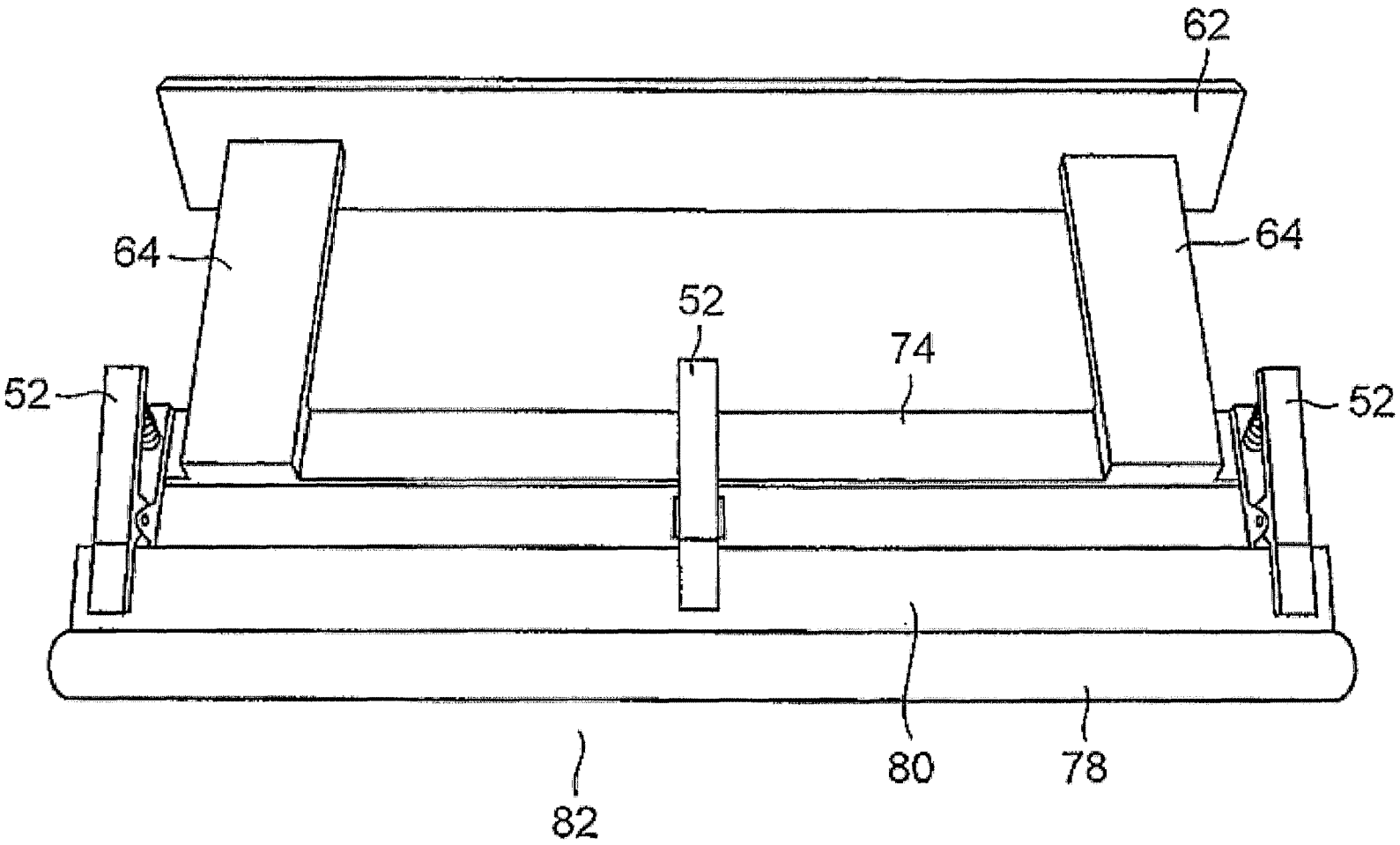
FIG. 8 is a view of the hanger 50.

FIG. 8 is a perspective view of the hanger 50. The hanging plates 64 extend in the downward direction from the top plate 62. The clip holding member 74 is fixed in a lateral direction to these hanging plates 64. The clips 52 are provided on both ends and a central portion of this clip holding member 74.

Figure 9:
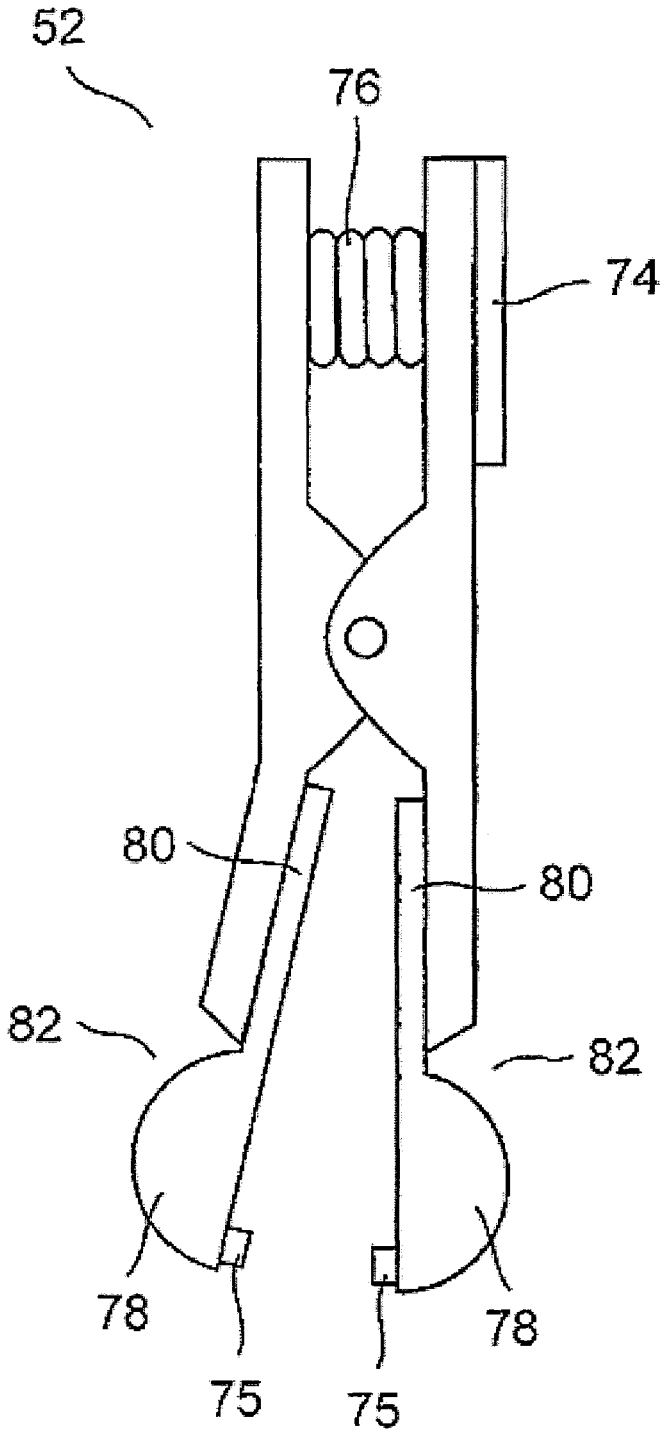
FIG. 9 is a view of a clip 52.

FIG. 9 is a detailed view of the clip 52. The clip 52 is urged in a direction of closing a tip thereof by a spring 76. FIG. 9 shows a state where the spring 76 is pressed against this spring 76 so as to open the tip. As shown in FIG. 8, at the tips of the clips 52, a treatment solution receiving member 82 is provided across entire width of the hanger 50. As shown in FIG. 9, each treatment solution receiving member 82 has a flat plate 80 in a root portion thereof and has a projected section 78 in a semicircular shape (preferably with a radius of 20 mm to 40 mm) that is projected outward at the tip thereof. Gripping projections 75 that sandwich and grip the substrate 54 therebetween are provided at lower inner ends of the projected sections 78.

Figure 13A:
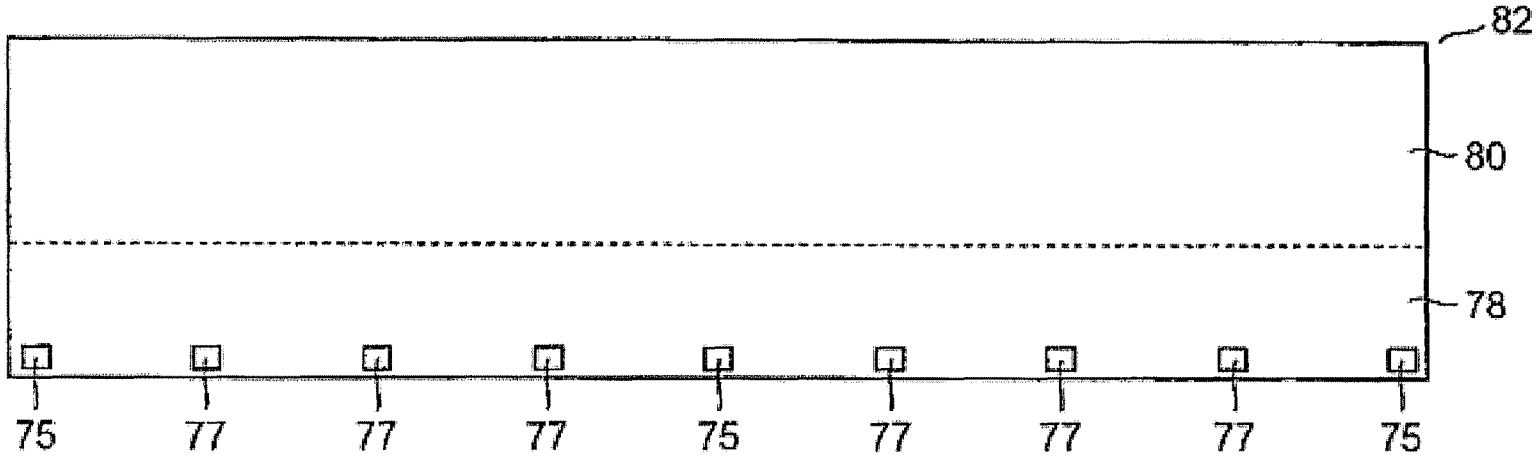
FIG. 13A and FIG. 13B are diagrams illustrating the structure of the inside of the treatment solution receiving member 82.
Figure 13B:
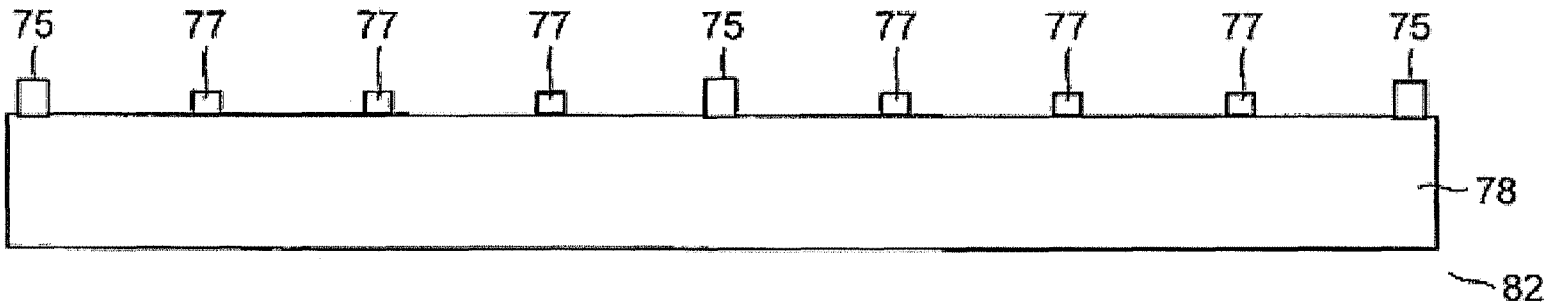

FIG. 13A is a view of the treatment solution receiving member 82 that is seen from an inner side. In this embodiment, the gripping projection 75 is provided at three positions of right and left ends and a central portion. In addition, adhesion prevention projections 77 are provided between the adjacent gripping projections 75. FIG. 13B is a bottom view of FIG. 13A. As it is apparent from this drawing, the adhesion prevention projections 77 are formed to be lower than the gripping projections 75. Accordingly, the upper end of the substrate 54 is sandwiched and held by the gripping projections 75.

Note that the adhesion prevention projections 77 are provided to prevent the substrate 54 from being bent (easily bent in a case of a thin substrate) and adhering to the treatment solution receiving member 82 in portions not provided with the gripping projections 75. In the cases where the substrate 54 adheres to the treatment solution receiving member 82 and an adhering area thereof is large, the substrate 54 remains adhering thereto even when the treatment solution flows thereto. As a result, the surface treatment cannot be performed in an adhering portion.

Returning to FIG. 4, the treatment solution is supplied to the pipe 56 by the pump 60 in FIG. 3. This treatment solution differs by each of the treatment sections. In this embodiment, a cleaning solution is used in the first cleaning section 24, the second cleaning section 28, the third cleaning section 32, and the fourth cleaning section 36. A desmear solution is used in the desmear section 26. A pretreatment solution is used in the pretreatment section 30. A plating solution is used in the electroless copper-plating section 34.

The hole 58 of the pipe 56 is provided to face upward at a specified angle (for example, 45 degrees). Accordingly, the treatment solution is released obliquely upward from the pipe 56 and reaches the clip 52. Note that the hole 58 is preferably directed in a range from 5 degrees to 85 degrees with respect to a horizontal direction. The hole 58 of the pipe 56 is provided at specified intervals (for example, intervals of 10 cm) in the perpendicular direction to the sheet.

Figure 10A:
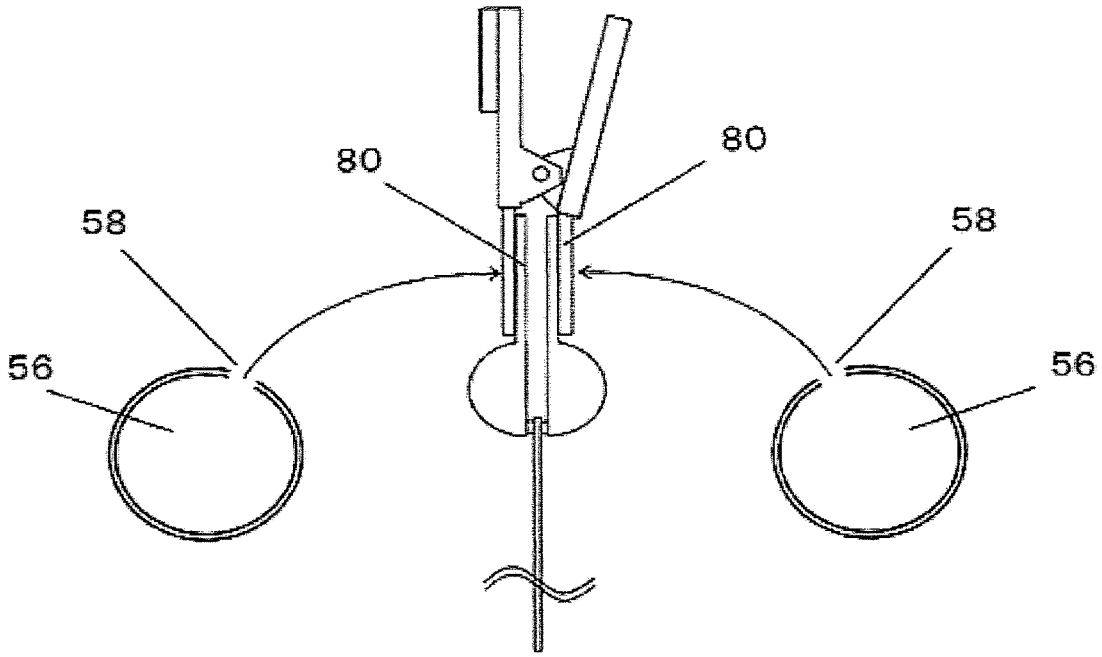
FIG. 10A is a diagram illustrating the state of treatment solution discharged from pipes 56.
Figure 10B:
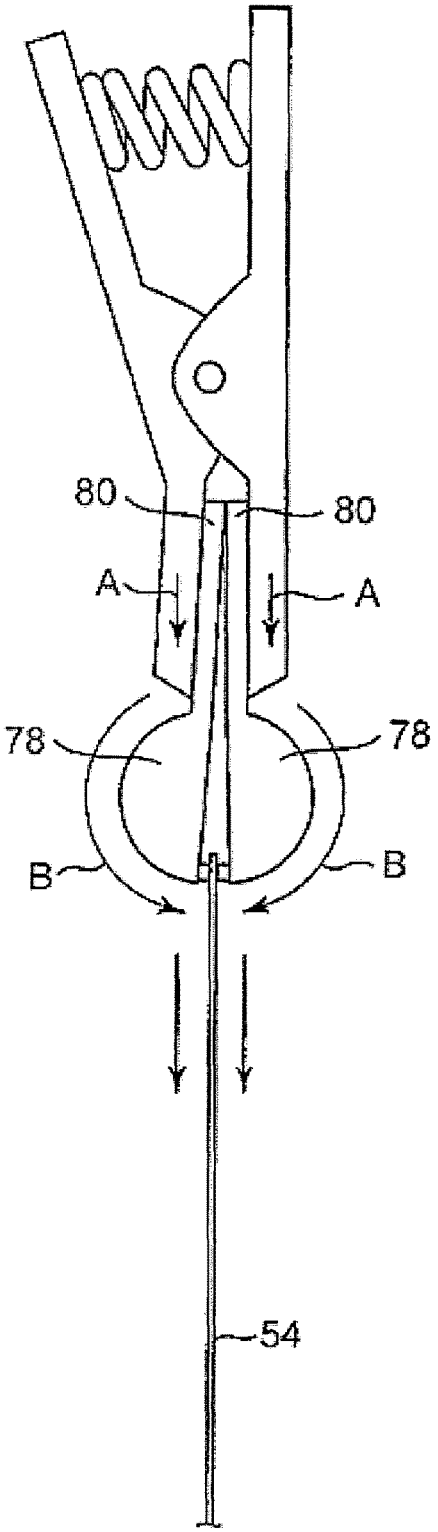
FIG. 10B is a view of a flow of the treatment solution in treatment solution receiving members 82.

As shown in FIG. 10A, the treatment solution that is jetted out of the hole 58 of the pipe 56 abuts against the flat plate 80 of the treatment solution receiving member 82 and flows in the downward direction. The flow of the treatment solution at this time is shown in FIG. 10B. The treatment solution that has abutted against the flat plate 80 flows on a surface of the flat plate 80 in an arrow A direction (the downward direction) while being spread laterally. As described above, the treatment solution is released at the specified intervals from the pipe 56, and the treatment solution that has abutted against the flat plate 80 is spread laterally. Accordingly, the treatment solution flows in the downward direction across an entire surface of the flat plate 80 in a width direction.

As indicated by an arrow B, the treatment solution that has flowed down on the surface of the flat plate 80 flows on a surface of the projected section 78 with a semi-circular cross section. The treatment solution that has reached a lower end of the projected section 78 flows down on the substrate 54. Accordingly, the treatment solution flows on the entire surface of the substrate 54, and the surface treatment is thereby performed.

Figure 11A:
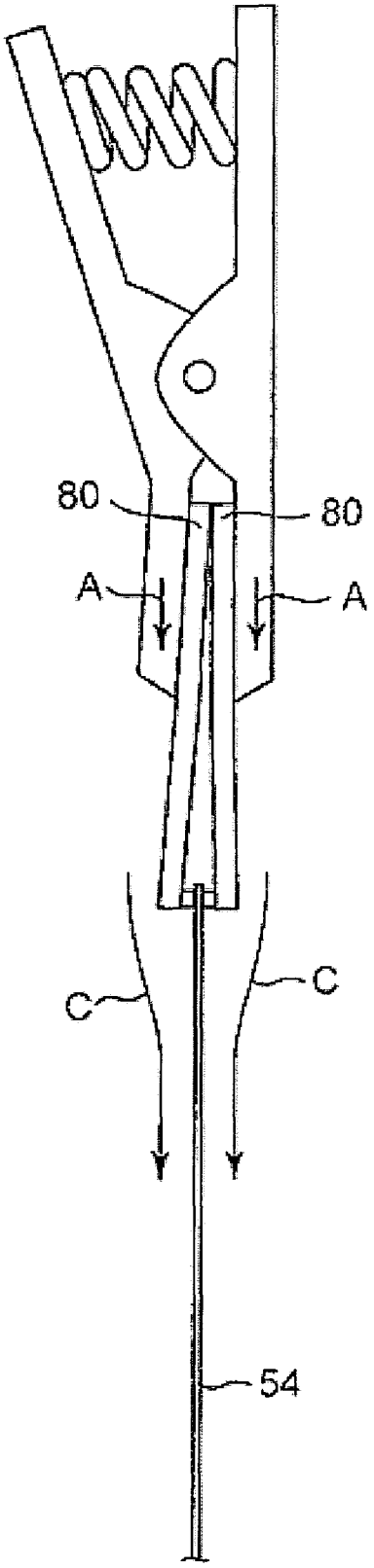
FIG. 11A and FIG. 11B are diagrams illustrating different shapes of the treatment solution receiving members 82.

Note that, when the treatment solution flows from the treatment solution receiving members 82 to the substrate 54, as shown in FIG. 10B, the treatment solution preferably flows onto the surface thereof at a substantially perpendicular angle. As shown in FIG. 11A, when flowing onto the surface thereof at a substantially horizontal angle, this solution rinses off an agent that is applied onto the surface of the substrate 54 (for example, vanadium during plating), and thus the appropriate surface treatment cannot be performed.

Figure 11B:
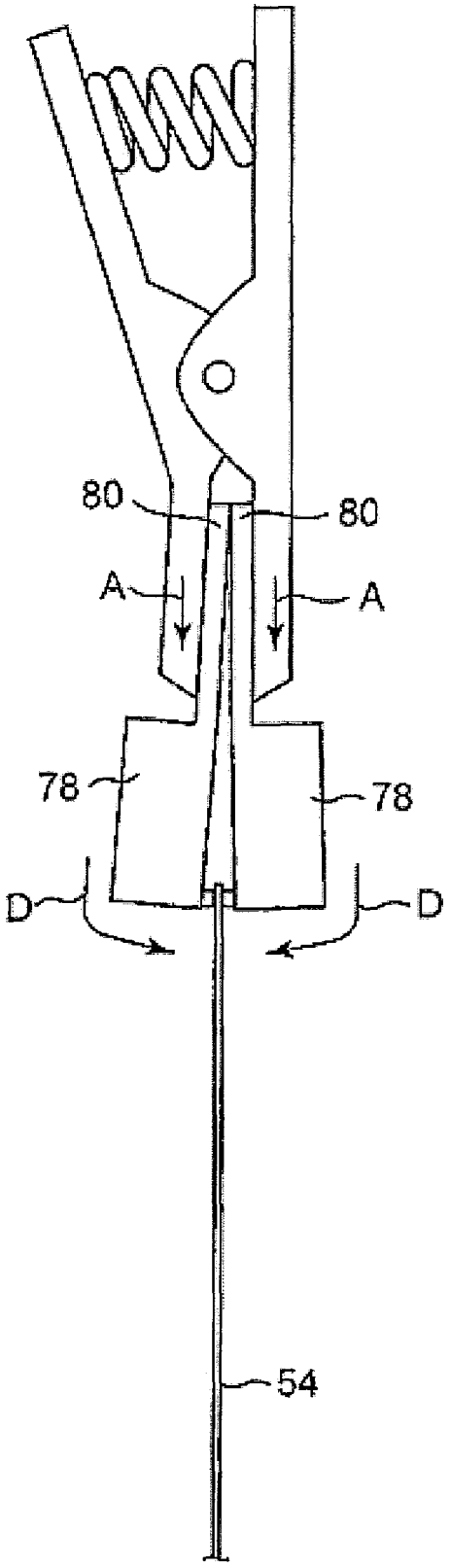

Thus, as shown in FIG. 11B, the projected section 78 is preferably provided to cause the treatment solution to flow onto the surface of the substrate 54 at the substantially perpendicular angle. However, in a case of a structure as shown in FIG. 11B, the treatment solution may not sufficiently flow around the projected sections 78 in an upper portion of the substrate 54, which possibly results in uneven application of the treatment solution. To handle this problem, in the above embodiment, the projected section 78 has an R shape (a curved surface shape), so as to allow the treatment solution to reliably flow therearound and thus to realize flowing of the treatment solution at the substantially perpendicular angle.

Figure 12A:
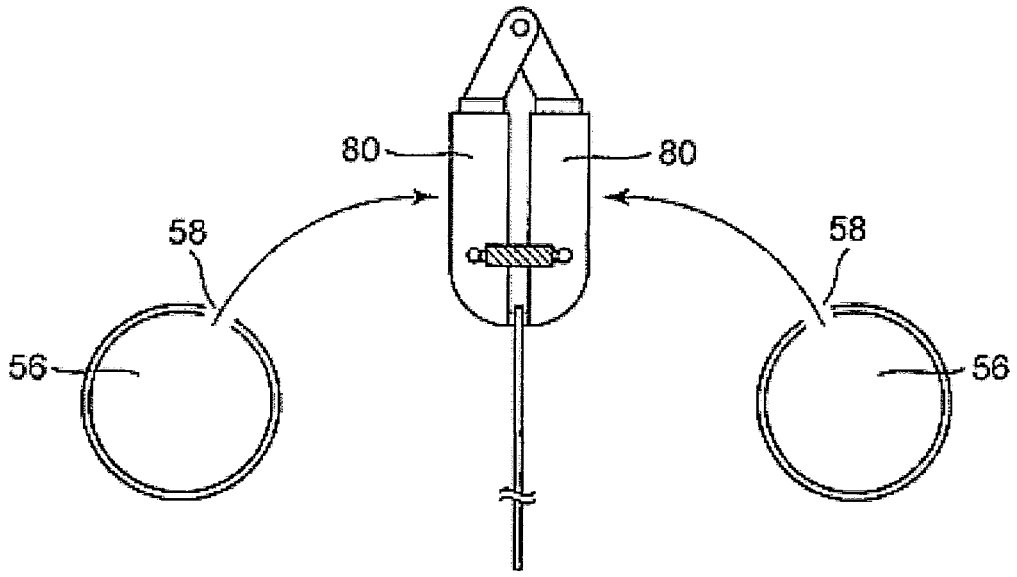
FIG. 12A and FIG. 12B are diagrams illustrating different shapes of the treatment solution receiving members 82.

For example, a similar effect may be achieved by providing an R portion at a lower outer end of the projected section 78 in FIG. 11B. Alternatively, as shown in FIG. 12A, the flat plate 80 may be formed thick (preferably having thickness of 20 mm to 40 mm), and an R portion (preferably Radius=10 mm or larger) may be provided at an outer tip thereof.

Figure 12B:
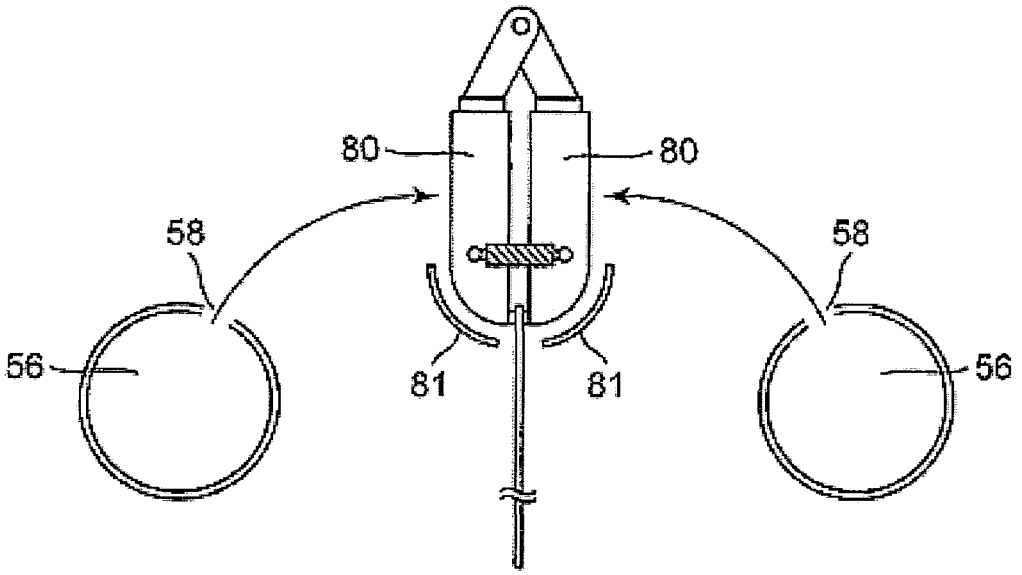

Furthermore, as shown in FIG. 12B, flow guides 81 may be provided. The treatment solution reliably flows toward the substrate 54 by the flow guides 81. Even in a structure as shown in FIG. 11B, the treatment solution can reliably flow toward the substrate 54 by using the flow guides 81.

In addition, near the lower end of the projected section 78, the treatment solution that has flowed therearound slightly moves in an upward direction. Thus, the treatment solution is spread to the upper end of the substrate 54. At this time, as shown in FIG. 13B, due to provision of the adhesion prevention projections 77, even when the substrate 54 is bent, the substrate 54 does not adhere to the treatment solution receiving member 82 and only contacts the adhesion prevention projections 77. Accordingly, the treatment solution that has flowed separates the substrate 54 from the adhesion prevention projections 77 and causes the substrate 54 to float thereon. In this way, the surface treatment can be performed evenly to the upper end of the substrate 54.

Note that the adhesion prevention structure shown in FIG. 13 can be applied not only to a method of making the treatment solution abut against the hanger 50 and flow on the substrate 54 but also to a method of making the treatment solution abut against a portion near the upper end of the substrate 54 and flow thereon.

Note that, as shown in FIG. 1, cleaning treatment is performed before (after) desmear treatment, pretreatment, and electroless copper-plating treatment. Also, in the cleaning treatment, cleaning water as the treatment solution flows to clean the surface of the substrate 54 in a similar manner to what has been described above. However, in the cleaning treatment, the position at which the treatment solution released from the pipe 56 abuts against the substrate 54 is set above (to be higher than) an abutment position thereof in the desmear treatment, the pretreatment, and the electroless copper-plating treatment. In this way, in the cleaning treatment, a desmear treatment solution, the pretreatment solution, and an electroless copper-plating treatment solution that adhere to the flat plate 80 can be further appropriately rinsed off.

Figure 14:
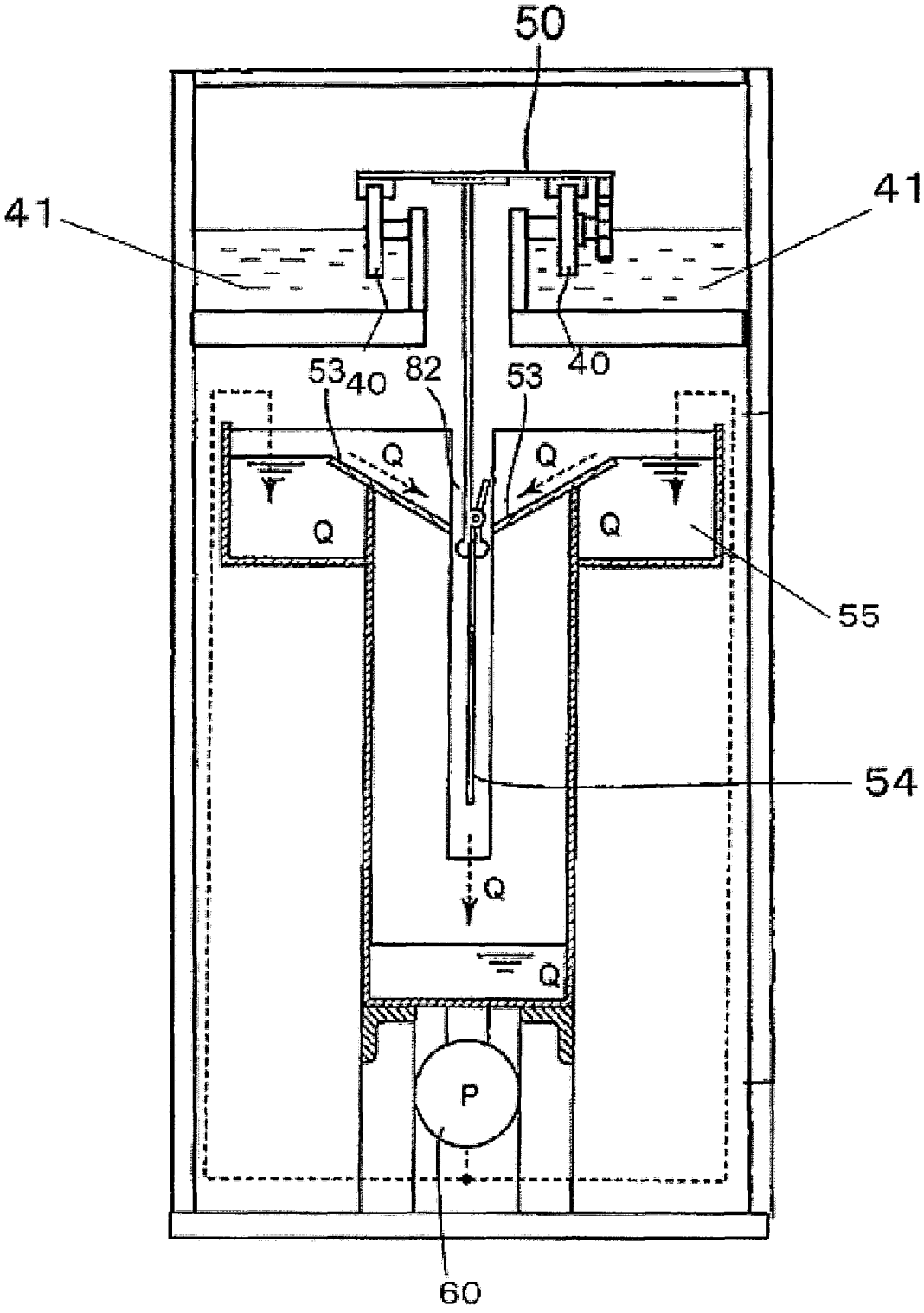
FIG. 14 is a diagram illustrating the structure of treatment solution releasing sections according to another example.

In addition, in the above embodiment, the treatment solution is released obliquely upward from the pipe 56. However, as shown in FIG. 14, the treatment solution may be released obliquely downward from slopes 53. The treatment solution pumped up by the pump 60 is stored in reservoirs 55. When the liquid level gets higher than the edges of the slopes 53, the treatment solution overflows onto the slopes 53. The treatment solution that has overflowed onto the slope 53 abuts against the treatment solution receiving member 82 and flows down on the substrate 54. In this case, the slope 53 corresponds to the treatment solution releasing section.

In the above embodiment, a case is described where the present invention is applied to a treatment bath in which a treatment solution is discharged onto the substrate 54. However, the present invention is also applicable to a treatment bath in which the substrate 54 is immersed into a treatment solution. Again, in this case, dust can be prevented from entering the treatment solution to cause a defect.

In the above embodiment, it is configured that the hanger 50 moves with respect to the pipes 56 and the reservoirs 55. However, the hanger 50 may be fixed, and the pipes 56 and the reservoirs 55 may move.

In the above embodiment, the liquid 41 is filled to such a degree that half of each rotary shaft 72 is immersed in the liquid 41. However, a sufficient effect can be achieved only if the liquid 41 is deep enough to contact at least the rollers 40. If possible, the liquid 41 may be filled to such a degree that the entire transferring mechanism is immersed in the liquid 41. Further, even when the liquid 41 is shallow enough not to contact the rollers 40, effects can be expected because the dust falling from the transferring mechanism can be captured.

In the above embodiment, the liquid 41 is used. However, the liquid 41 may not be used. Without the liquid 41, the dust preventive effect decreases. Even so, the lateral protective walls 49 and the lower protective walls 47 can prevent the dust generated (stirred up) by the transferring mechanism from migrating toward the substrate 54. In addition, only the lower protective walls 47 may be provided without the lateral protective walls 49. Even in this case, a certain level of dust preventive effect can be expected.

In the above embodiment, the rollers 40 and the pinions 70 are supported by the lateral protective walls 49. However, the rollers 40 and the pinions 70 may be supported by the lower protective walls 47 or the outer walls 39.

In the above embodiment, the roller guides 66 are provided on the top plate 62 side and the rollers 40 are provided on the lateral protective wall 49 side in the hanger 50. However, the rollers 40 may be provided on the top plate 62 side and the roller guides 66 may be provided on the lateral protective wall 49 side.

In the above embodiment, the rack 68 is provided on the top plate 62 side and the pinions 70 are provided on the lateral protective wall 49 side in the hanger 50. However, the pinions 70 may be provided on the top plate 62 side and the rack 68 may be provided on the lateral protective wall 49 side.

While water is used as the liquid in the above embodiment, a lubricating oil or the like may be used.

In the above embodiment, protective walls are used as protective members to physically prevent dust from migrating. However, ions or the like may be generated to adsorb dust electrically or magnetically in order to prevent migration of dust. Alternatively, dust may be caused to repel to prevent dust from migrating toward the substrate 54. Further, a mechanism that sucks dust may be provided.

In the above embodiment, the treatment solution collecting port/air discharging port 13 is provided and used as a treatment solution collecting port and an exhaust port. However, they may be separately provided.

In the above embodiment, the intake 11 is provided above the lower protective wall 47. However, the intake 11 may be provided below the lower protective wall 47.

In the above embodiment, the treatment solution collecting port/air discharging port 13 is provided in both of the front end portion and the rear end portion of each body 4. However, the treatment solution collecting port/air discharging port 13 may be provided in only one of them. Alternatively, three or more treatment solution collecting port/air discharging ports 13 may be provided.

In the above embodiment, the discharged treatment solution abuts against the hanger 50 and is guided to the substrate 54. However, the treatment solution may be directly discharged onto the substrate 54.

In the above embodiment, the intake 11 as an air intake is provided in the highest portion of the body 4, and the treatment solution collecting port/air discharging port 13 as an air discharging port is provided in the lowest portion of the bath. However, an effect of improving nonuniformity in temperature can be obtained by providing the air discharging port below the air intake. At this time, it is preferable for the improvement of nonuniformity in temperature that the air intake is provided above the upper end of the substrate 54 (or the upper end thereof that contacts the treatment solution), and the air intake is provided below the lower end of the substrate 54. Note that it is preferable that the air discharging port is at least provided below the air intake and the lower end of the substrate 54 in order to prevent the substrate 54 from swinging.

In the above embodiment, each of the treatment sections is provided with the inlet 44 and the outlet 46 as communicating ports. By providing the inlet 44 and the outlet 46 with a shutter designed to open and close, an effect of preventing the discharge of the harmful mist to the outside of the body 4 can be obtained.

2. Second Embodiment

In the first embodiment, the structure of the one hanger 50 that causes the treatment solution to appropriately flow on the substrate 54 has been described. A second embodiment, which will be described below, relates to a case where the plurality of hangers 50 respectively hold the substrates 54 and the treatment solution flows on these substrates 54 as a group.

In order to simplify a description, a case where the plurality of hangers 50 are applied to the surface treating apparatus of the first embodiment will be described below. However, the plurality of hangers 50 can be applied to any surface treating apparatus as long as a method of causing the treatment solution to flow on the surface of the substrate 54 is adopted therefor.

Figure 15:
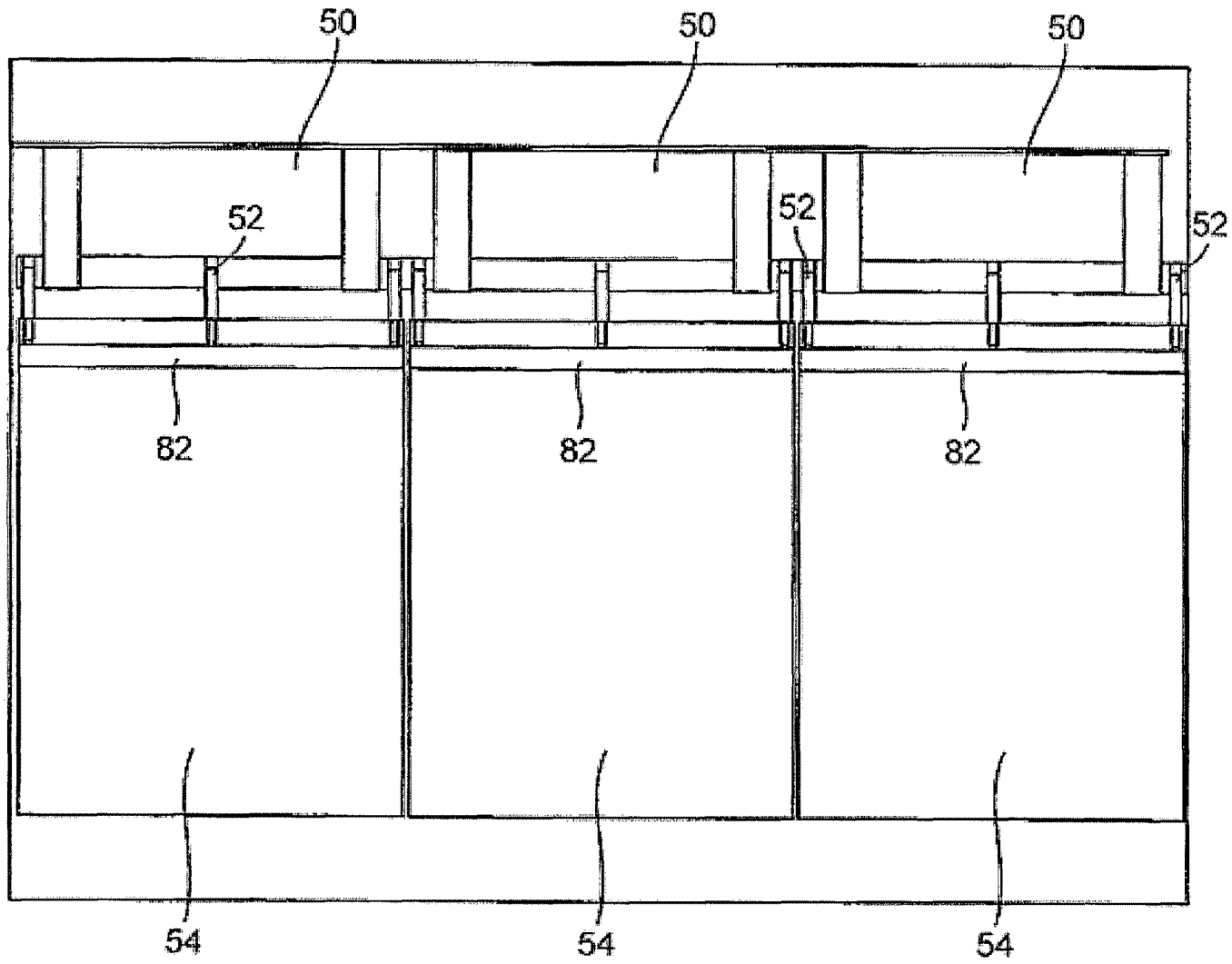
FIG. 15 is a view of the successively-arranged hangers 50 and retained substrates 54.

FIG. 15 shows a state where the plurality of substrates 54, which are respectively held by the hangers 50, are arranged. The substrate 54 is held across the width of the hanger 50. Treatment capacity is increased when a clearance between the adjacent substrates 54 is reduced to be as narrow as possible. In this embodiment, a distance of 5 mm to 15 mm is provided between the adjacent substrates 54. It is, however, difficult to reduce the distance between the substrates 54 to 0 mm. This is because, when an error occurs to a transporting speed of each of the hangers 50, the adjacent substrates 54 overlap and adhere to each other, which possibly leads to twisting and tearing of the substrates 54.

A distance of 5 mm to 15 mm is also provided between the hangers 50. This is because, when feeding speeds of the hangers 50 do not match completely, the hangers 50 come in contact with each other, the hangers 50 are tilted, and the adjacent substrates 54 possibly come in contact with each other. Needless to say, when the feeding speed of each of the hangers 50 is set to be precisely constant, this clearance can be reduced. However, a complicated and expensive mechanism becomes necessary.

Just as described, the specified clearance has to be provided between the adjacent hangers 50 and between the adjacent substrates 54. Under normal circumstances, the treatment solution does not have to flow between the substrate 54 and the substrate 54. This is because the substrate 54 is not provided in such a portion and thus the surface treatment using the treatment solution is unnecessary.

Figure 16:
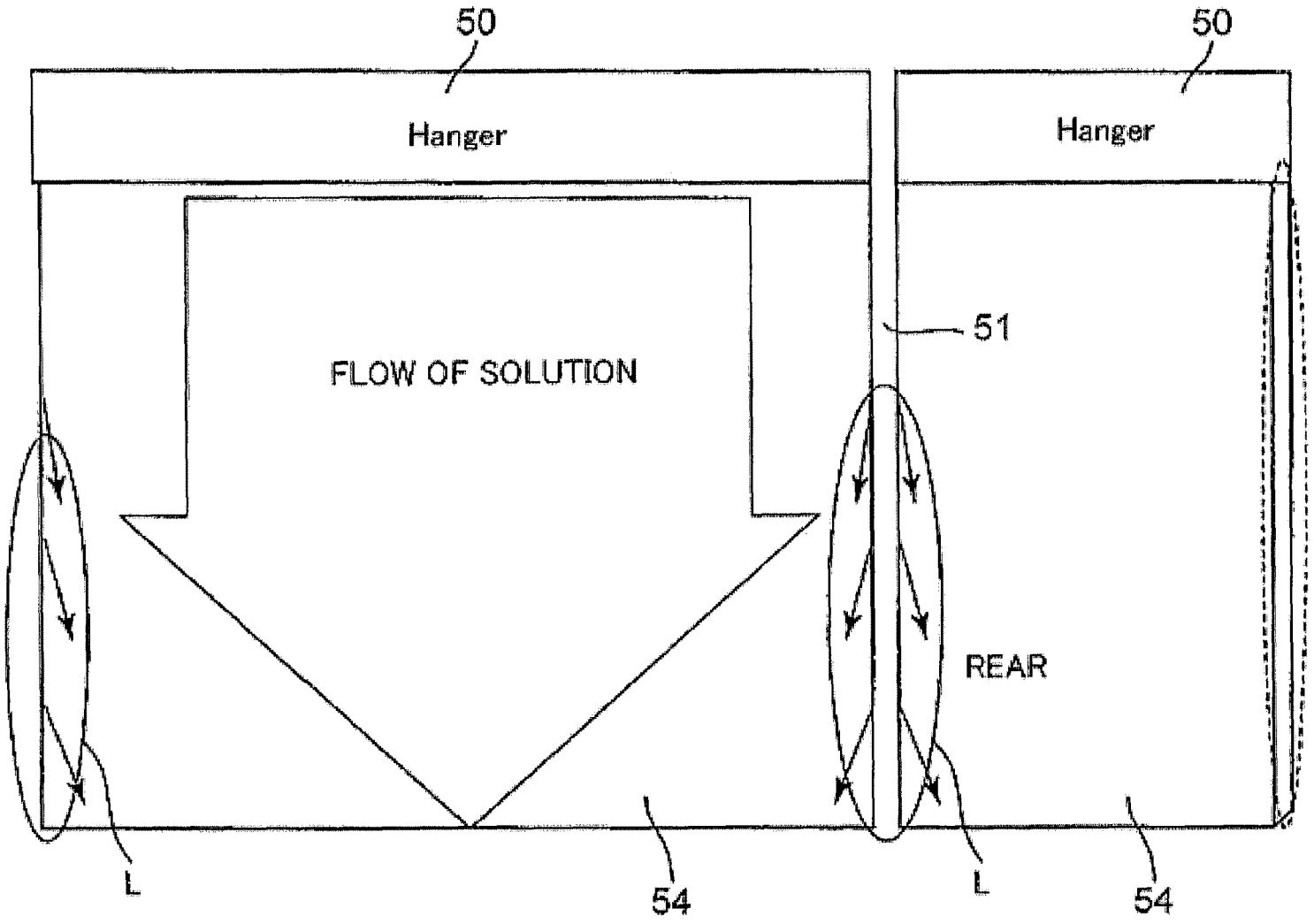
FIG. 16 is a view of a flow of the solution in FIG. 15.

However, as schematically shown in FIG. 16, because the treatment solution does not flow through a space 51 between the hanger 50 and the hanger 50, a quantity of the treatment solution that flows on an end is reduced in a lower portion L of the substrate 54 due to surface tension. This leads to a problem of the uneven surface treatment of the substrate 54.

Figure 17:
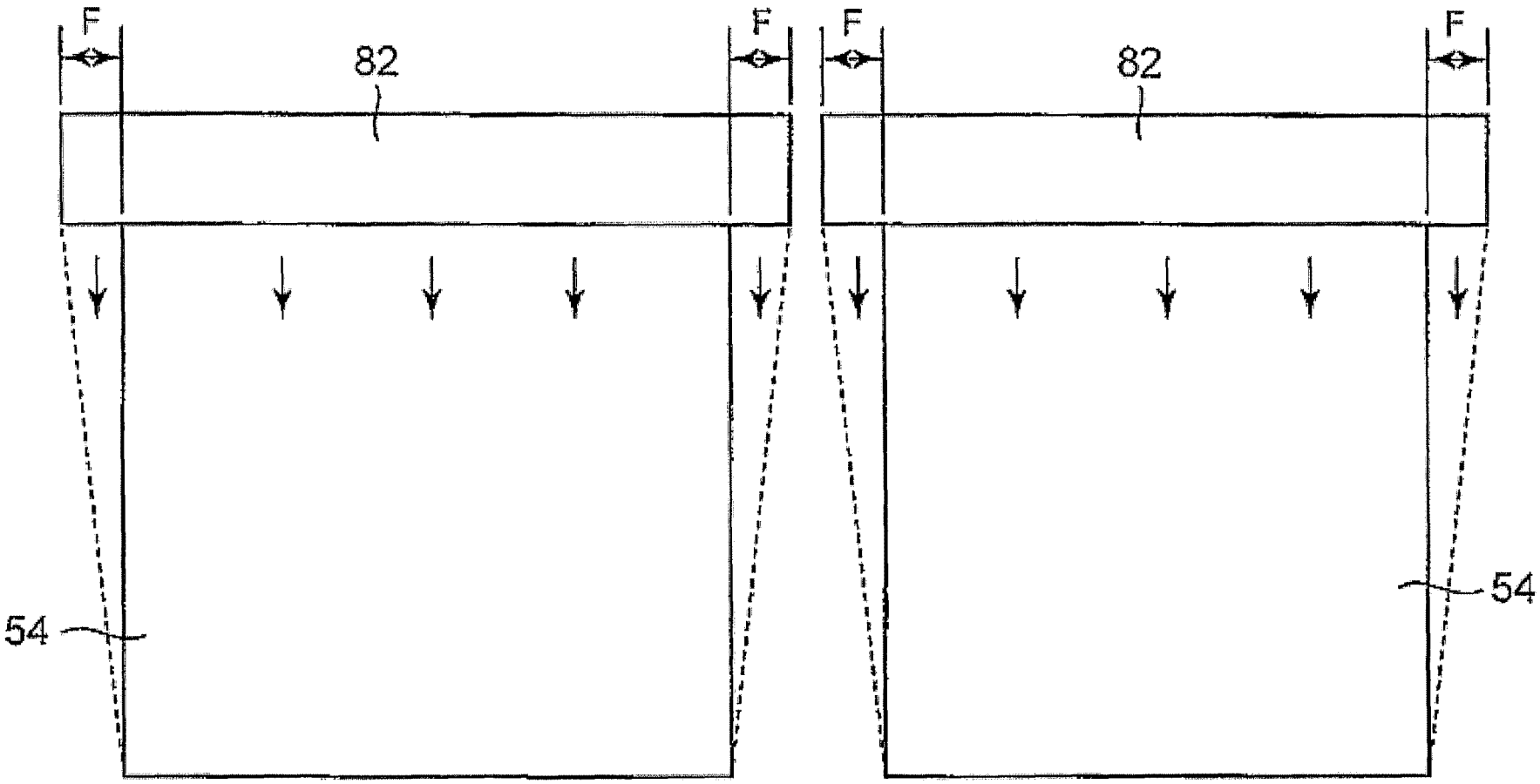
FIG. 17 is a view of a flow of the treatment solution at a time when the hangers 50 are projected.

To handle this problem, in the second embodiment, a structure that causes the treatment solution to flow through spaces on outer sides of right and left ends of the substrate 54 is adopted. FIG. 17 shows an example of such a structure. In this example, the treatment solution receiving member 82 of the hanger 50 is wider than the substrate 54. Accordingly, as indicated by arrows in the drawing, the treatment solution also flows on the outer sides of the substrate 54. A layer of this treatment solution approaches an end of the substrate 54 as flowing in the downward direction, and is eventually absorbed into the flow in the substrate 54. However, when a degree of projection F of the treatment solution receiving member 82 is substantially large, the layer of the treatment solution can be formed on the outer sides of the right and left ends of the substrate 54 up to the lower end thereof (see broken lines).

However, in the structure shown in FIG. 17, the large clearance is provided between the substrate 54 and the substrate 54. Thus, the number of the substrates 54 that can be treated per unit time is reduced. When a yield of the treatment becomes problematic just as described, the treatment solution receiving member 82 may adopt a structure as shown in FIG. 18.

Figure 18:
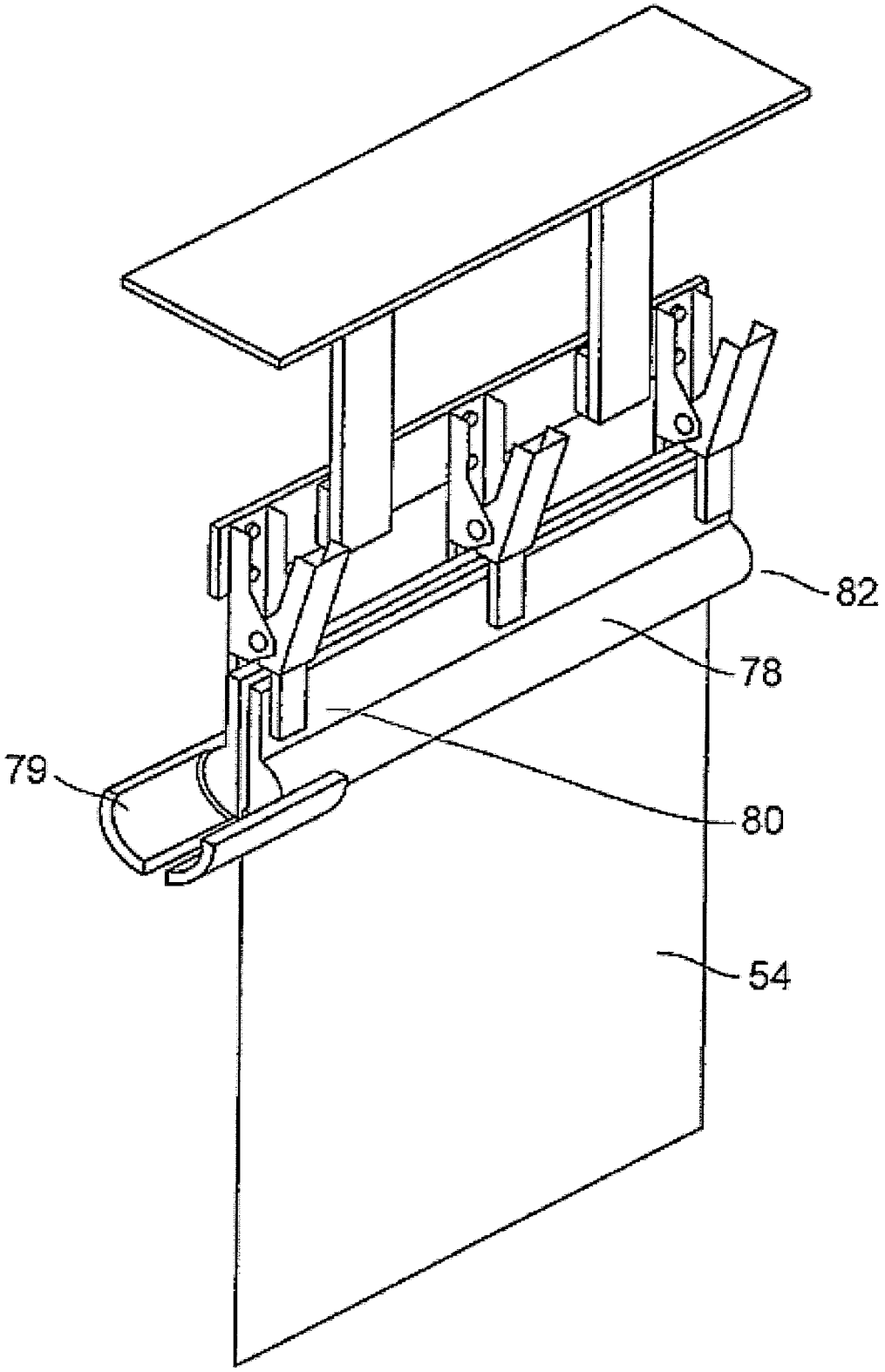
FIG. 18 is a diagram illustrating the state where guide members 79 are provided.
Figure 19C:
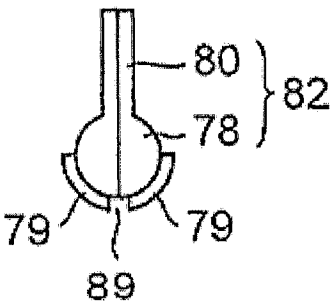
FIG. 19A, FIG. 19B, and FIG. 19C are diagrams illustrating details of the guide members 79.
Figure 19A:
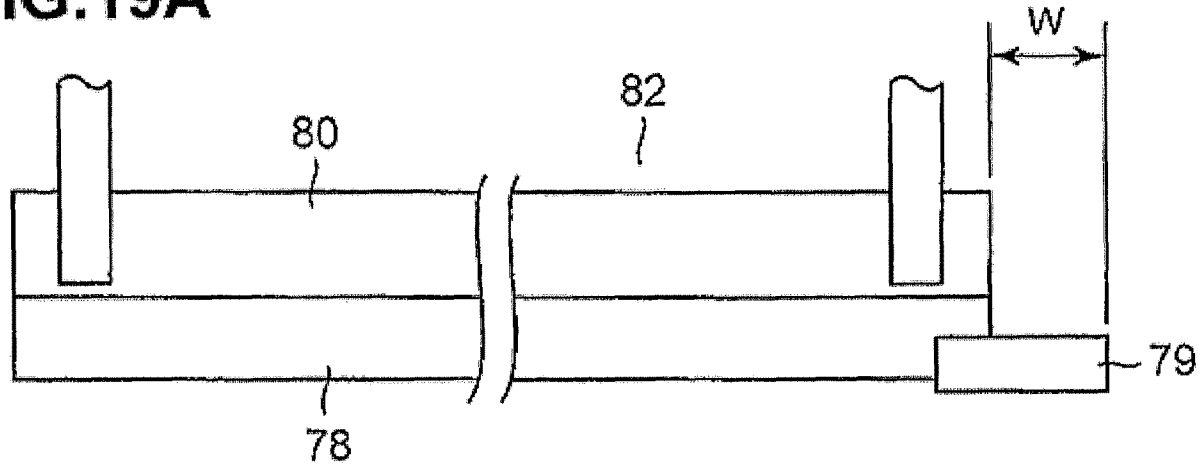
Figure 19B:
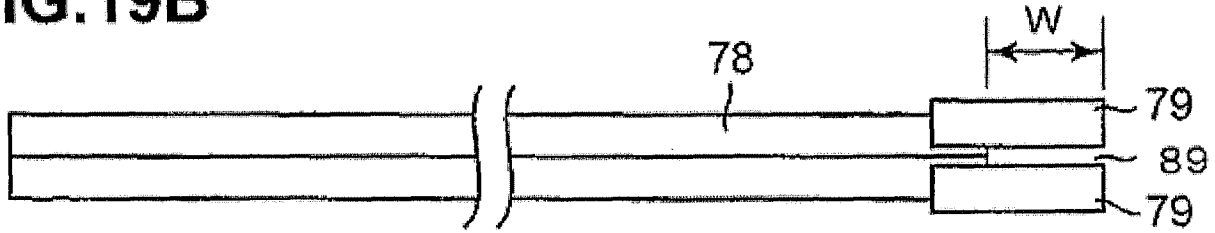

In FIG. 18, guide members 79 are provided on one side of the projected sections 78 in the treatment solution receiving members 82. FIG. 19A is a front view thereof, FIG. 19B is a bottom view thereof, and FIG. 19C is a side view thereof.

The guide member 79 is provided on an outer side of the projected section 78 in a manner to follow an outer shape thereof. In this embodiment, the guide member 79 is provided along a lower half of the R portion of the projected section 78. The guide member 79 does not completely cover a lower side of the projected section 78 but is provided such that a space 89 is produced at the lower end thereof. In addition, the guide member 79 is provided in a manner to be projected by W from the width of the projected section 78.

Figure 20:
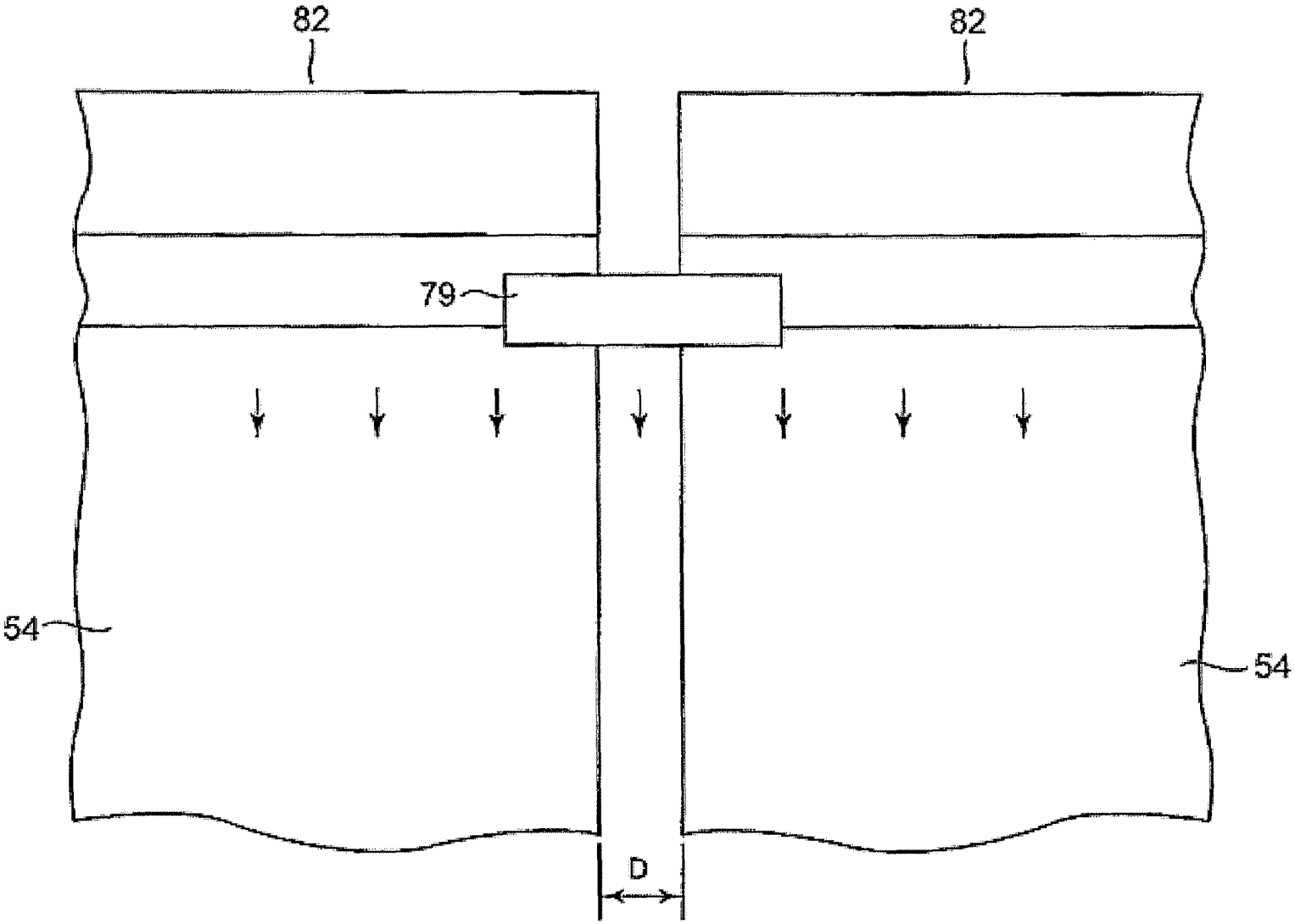
FIG. 20 is a diagram for explaining the function of the guide members 79.

FIG. 20 shows states of the adjacent treatment solution receiving members 82 at a time when the plurality of hangers 50 are transferred. A front end of the rear (right) treatment solution receiving member 82 enters the guide member 79 that is provided at a rear end of the front (left) treatment solution receiving member 82. Furthermore, a front end of the rear (right) substrate 54 enters the space 89 (see FIG. 19C) of the front (left) guide member 79. In this way, the front end of the rear (right) substrate 54 overlaps a portion of the adjacent front (left) guide member 79. At this time, the treatment solution receiving members 82 of the hangers 50 and the substrates 54 are transferred with a specified gap D (5 mm to 15 mm in this embodiment) being interposed therebetween. At this time, the treatment solution that has been released from the pipe 56 is received by the guide member 79 and is dropped from the space 89 (see FIG. 19C) toward the gap D. Accordingly, a film of the treatment solution is also formed in a portion corresponding to the gap D. Thus, while the problem as shown in FIG. 16 is solved, the surface treatment with little unevenness can be realized.

As it has been described so far, according to the embodiment shown in FIG. 20, the surface treatment with little unevenness can be performed without increasing the gap between the substrates 54. Note that the guide members 79 are provided on the only one side of the treatment solution receiving members 82 in the above description. However, the hanger 50 that is provided with the guide members 79 on both of the sides and the hanger 50 that is not provided with the guide members 79 may be alternately arranged for use.

Figure 21C:
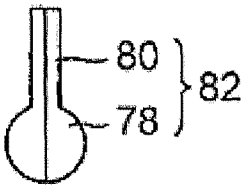
FIG. 21A, FIG. 21B and FIG. 21C are diagrams illustrating the structure of treatment solution receiving members 82 according to another example.
Figure 21A:
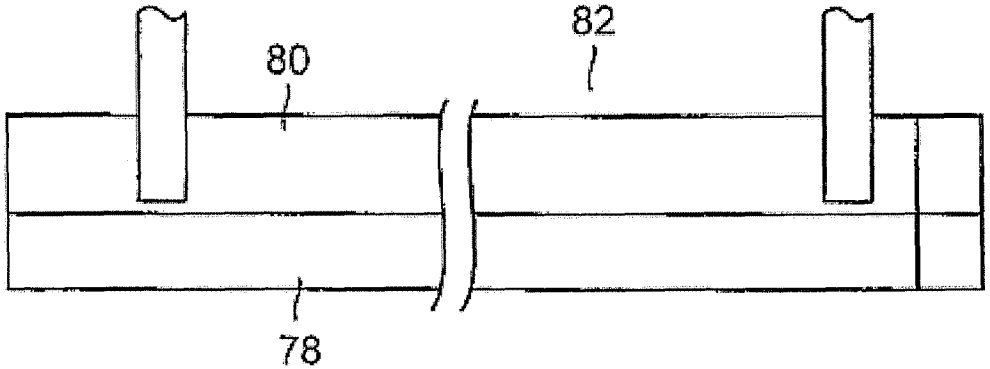
Figure 21B:
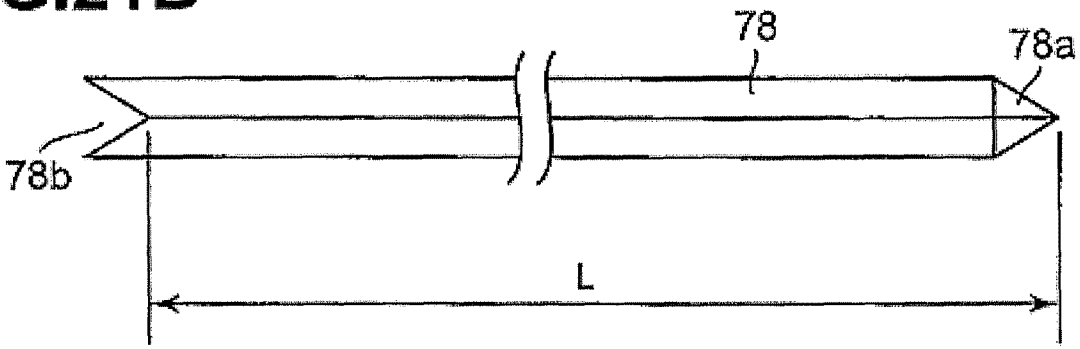

In addition, as shown in FIG. 21, a projected section 78*a* may be formed by tapering one side of the treatment solution receiving member 82 (the projected section 78) as a point, and a recessed section 78*b* that corresponds thereto may be formed on an opposite side. FIG. 21A is a front view thereof, FIG. 21B is a bottom view thereof, and FIG. 21C is a side view thereof. In this case, the substrate 54 may be attached across a length L in FIG. 21B. The projected section 78*a* of each hanger 50 is received in the recessed section 78*b* of an adjacent hanger 50 (however, a distance of 5 mm to 15 mm is provided so that the hangers 50 do not contact each other). In this way, the layer of the flow of the treatment solution can also be formed between the substrate 54 and the substrate 54.

Note that the projected section 78*a*, which is tapered and pointed, and the recessed section 78*b*, which corresponds thereto, are provided in FIG. 21. However, as long as the projected section and the recessed section have such shapes that one enters the other, any shape can be adopted therefor. For example, the columnar projected section 78*a*, the recessed section 78*b* in a corresponding shape thereto, or the like may be used.

Figure 22C:
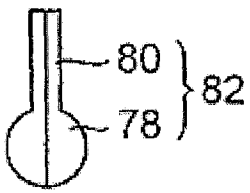
FIG. 22A, FIG. 22B and FIG. 22C are diagrams illustrating the structure of treatment solution receiving members 82 according to another example.
Figure 22A:
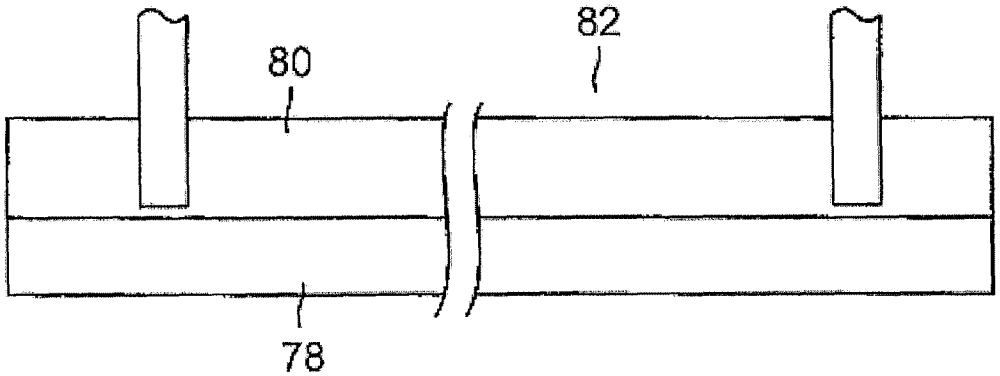
Figure 22B:
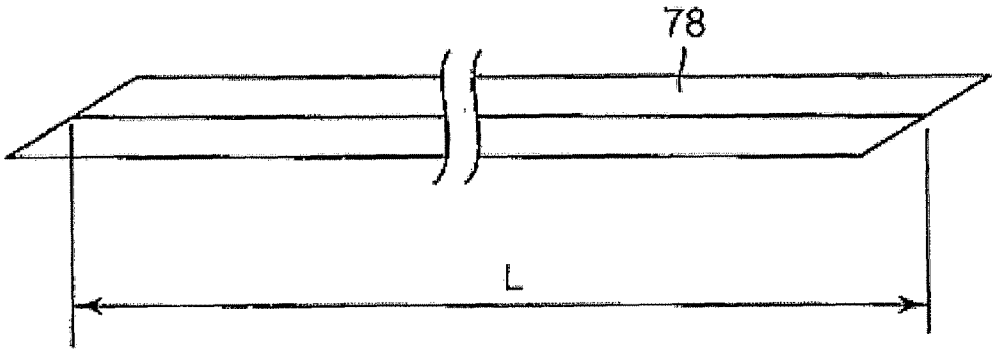

In addition, as shown in FIG. 22, both ends of the treatment solution receiving member 82 (the projected section 78) may be formed obliquely. FIG. 22A is a front view thereof, FIG. 22B is a bottom view thereof, and FIG. 22C is a side view thereof.

Figure 23C:
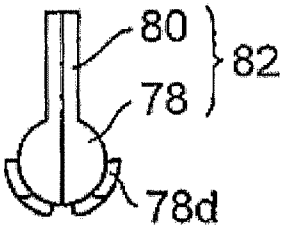
FIG. 23A, FIG. 23B and FIG. 23C are diagrams illustrating the structure of treatment solution receiving members 82 according to another example.
Figure 23A:
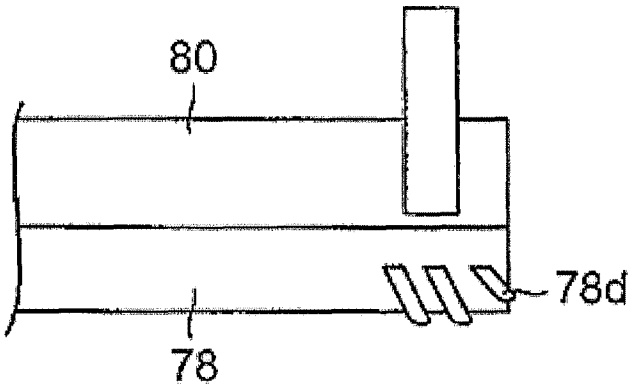
Figure 23B:
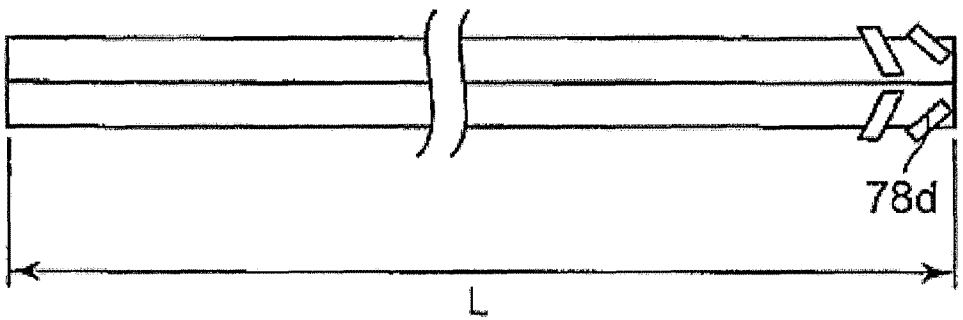

In addition, as shown in FIG. 23, protrusions 78*d* for changing the direction of flow may be provided at both ends of the treatment solution receiving members 82 (the projected sections 78). FIG. 23A is a front view thereof, FIG. 23B is a bottom view thereof, and FIG. 23C is a side view thereof. In this way, at both of the ends, the treatment solution is drifted to the outer sides, and thus the treatment solution can also flow through a space between the substrate 54 and the substrate 54.

While thin substrates (with a thickness of several dozen μm) that cannot stand on their own in a natural state are described as targets of treatment in the above embodiments. However, a thick substrate can also be the treatment target.

The second embodiment can be implemented in combination with the first embodiment but can also be implemented independently from the first embodiment.

A general description of the present invention as well as preferred embodiments of the invention has been set forth above. It is to be expressly understood, however, the terms described above are for purpose of illustration only and are not intended as definitions of the limits of the invention. Those skilled in the art to which the present invention pertains will recognize and be able to practice other variations in the system, device, and methods described which fall within the teachings of this invention.

Accordingly, all such modifications are deemed to be within the scope of the invention.

What is claimed is:

1. A surface treating apparatus comprising:

a bath section enclosed by outer walls;

a clip adapted to hold an upper portion of a treatment target of plate;

a pipe adapted to discharge a treatment solution onto the clip or the treatment target to allow the treatment solution to flow on a surface of the treatment target held by the clip; and a body inside the bath section that includes at least the pipe, rollers and roller guides, and the treatment target, wherein air is provided via air intakes in an upper portion of the body, the body is within the outer walls and an air discharging port is provided in a lower portion of the body; and wherein the body has no openings in communication with outside air except the air intakes, the air discharging port, an inlet and an outlet.

2. The surface treating apparatus according to claim 1, wherein the air is provided above a portion where the treatment solution discharged from the pipe contacts the treatment target, and the air discharging port is provided below the treatment target.

3. The surface treating apparatus according to claim 1, wherein the air discharging port is used as a collecting port for collecting the treatment solution.

4. The surface treating apparatus according to claim 1, further comprising:

a top plate connected to a hanging plate that support the clip from above;

wherein the rollers and roller guides allow movement of the top plate connected to the hanging plate; and the outer walls are located at least on a lower side of the rollers and roller guides, wherein the top plate and the hanging plate support the clip through a part where no protective member is provided.

5. The surface treating apparatus according to claim 4, wherein the outer walls are also provided on side surfaces of the rollers and roller guides.

6. The surface treating apparatus according to claim 5, wherein a fluid is filled in a space defined by the outer walls, lower protective walls and lateral protective walls so that the lower side of the rollers and roller guides or at least a part of the rollers and roller guides can be immersed in the fluid.

7. The surface treating apparatus according to claim 6, wherein a water supply port and a water drain port are provided in the space defined by the outer walls so that the fluid can be replaced.

8. The surface treating apparatus according to claim 6, wherein the rollers and roller guides are formed of stainless steel, titanium, carbon steel, brass, and/or plastic.

* * * * *